US010087715B2

(12) United States Patent
Behr et al.

(10) Patent No.: US 10,087,715 B2
(45) Date of Patent: Oct. 2, 2018

(54) ARRANGEMENT AND METHOD FOR INTRODUCING HEAT INTO A GEOLOGICAL FORMATION BY MEANS OF ELECTROMAGNETIC INDUCTION

(71) Applicants: SIEMENS AKTIENGESELLSCHAFT, München (DE); WINTERSHALL HOLDING GMBH, Kassel (DE)

(72) Inventors: Aron Behr, Kassel (DE); Erich Leβner, Ahnatal (DE); Vladimir Stehle, Kassel (DE); Bernd Wacker, Herzogenaurach (DE)

(73) Assignee: Siemens Aktiengesellschaft, München (DE)

( * ) Notice: Subject to any disclaimer, the term of this patent is extended or adjusted under 35 U.S.C. 154(b) by 461 days.

(21) Appl. No.: 14/650,302

(22) PCT Filed: Nov. 22, 2013

(86) PCT No.: PCT/EP2013/074457
§ 371 (c)(1),
(2) Date: Jun. 6, 2015

(87) PCT Pub. No.: WO2014/086594
PCT Pub. Date: Jun. 12, 2014

(65) Prior Publication Data

US 2015/0315887 A1 Nov. 5, 2015

(30) Foreign Application Priority Data

Dec. 6, 2012 (EP) ..... 12195930
Dec. 6, 2012 (EP) ..... 12195958

(51) Int. Cl.
*E21B 36/04* (2006.01)
*E21B 43/16* (2006.01)
(Continued)

(52) U.S. Cl.
CPC ..... *E21B 36/04* (2013.01); *E21B 43/16* (2013.01); *E21B 43/2401* (2013.01);
(Continued)

(58) Field of Classification Search
CPC ..... E21B 36/04; E21B 43/16; E21B 43/2401; E21B 43/2408; E21B 43/305;
(Continued)

(56) References Cited

U.S. PATENT DOCUMENTS 3,782,470 A 1/1974 West et al.
3,948,319 A 4/1976 Pritchett
(Continued)

FOREIGN PATENT DOCUMENTS

DE 102004009896 A1 9/2005
DE 102007008292 A1 8/2008
(Continued)

OTHER PUBLICATIONS

European Office action for related European Application No. 12195930.8-1610, dated Jun. 12, 2013, with English Translation.
(Continued)

*Primary Examiner* — Yong-Suk Ro
(74) *Attorney, Agent, or Firm* — Lempia Summerfield Katz LLC

(57) ABSTRACT

An arrangement and method is provided for introducing heat into a geological formation (e.g., a deposit present in a geological formation) in order to recover a hydrocarbon-containing substance from the deposit, where at least one underground mine working has been mined in the geological formation and the mine working includes at least one shaft and/or at least one gallery. An electrical conductor is introduced at least partially in the geological formation. The conductor extends in a first conductor piece within the mine working. The conductor has at least one conductor section
(Continued)

configured such that, during operation, an electromagnetic field acts by electromagnetic induction on the ground adjacent to the conductor section so as to bring about an increase in temperature, and thus a decrease in the viscosity of a substance present in the adjacent ground. A second conductor piece of the conductor is also arranged in a bore in the ground.

16 Claims, 19 Drawing Sheets

(51) Int. Cl.
*E21B 43/30* (2006.01)
*E21B 43/24* (2006.01)
*E21C 41/16* (2006.01)

(52) U.S. Cl.
CPC ..... *E21B 43/2408* (2013.01); *E21B 43/305* (2013.01); *E21C 41/16* (2013.01); *H05B 2214/03* (2013.01)

(58) Field of Classification Search
CPC ..... E21B 35/00; E21B 43/24; E21C 41/16; E21C 41/24; H05B 2214/03; H01Q 1/04; H01Q 9/16; H01Q 9/24
See application file for complete search history.

(56) References Cited

U.S. PATENT DOCUMENTS 3,976,137 A 8/1976 Bousaid
4,127,172 A 11/1978 Redford et al.
4,458,945 A 7/1984 Ayler et al.
5,270,311 A 12/1993 Caulkett et al.
5,339,898 A 8/1994 Yu et al.
5,751,895 A * 5/1998 Bridges ..... E21B 36/04 392/306
2006/0151166 A1 7/2006 Montgomery et al.
2010/0108318 A1 5/2010 Diehl et al.
2010/0146981 A1 6/2010 Motakef et al.
2010/0252249 A1 10/2010 Diehl et al.
2011/0042063 A1 2/2011 Diehl et al.
2011/0048717 A1 3/2011 Diehl et al.
2012/0006138 A1* 1/2012 Smith, II ..... B21B 35/147 74/467
2012/0018140 A1* 1/2012 Parsche ..... E21B 43/2401 166/60
2012/0061080 A1* 3/2012 Sultenfuss ..... E21B 43/2401 166/302
2012/0061380 A1* 3/2012 Parsche ..... E21B 36/04 219/618
2012/0067572 A1* 3/2012 Trautman ..... E21B 43/2401 166/272.3
2012/0067580 A1* 3/2012 Parsche ..... E21B 43/2401 166/302
2012/0073798 A1* 3/2012 Parsche ..... E21B 36/04 166/53
2012/0118565 A1* 5/2012 Trautman ..... E21B 43/16 166/272.6
2012/0125607 A1 5/2012 Parsche
2012/0125608 A1* 5/2012 Parsche ..... E21B 43/2401 166/272.1
2012/0125609 A1* 5/2012 Parsche ..... E21B 43/2401 166/272.1
2012/0318498 A1* 12/2012 Parsche ..... E21B 43/14 166/248
2013/0192825 A1* 8/2013 Parsche ..... E21B 43/2408 166/272.1
2013/0333878 A1 12/2013 Stone et al.
2016/0281482 A1 9/2016 Nguyen et al.

FOREIGN PATENT DOCUMENTS

DE 102007040605 B3 10/2008
DE 102007036832 B4 8/2009
DE 102008022176 A1 11/2009
DE 102008056257 A1 5/2010
RU 2262593 C1 10/2005
RU 2268356 C1 1/2006
RU 2289684 C1 12/2006
RU 2343276 C1 1/2009
RU 2415259 C2 3/2011
RU 2524584 C2 7/2014
WO WO2008098850 A1 8/2008
WO WO2009027305 A2 3/2009
WO WO2009135806 A1 11/2009
WO WO2010023035 A1 3/2010

OTHER PUBLICATIONS

PCT International Search Report and Written Opinion of the International Searching Authority dated Feb. 3, 2014 for corresponding PCT/EP2013/074457.
Russian Office Action for Russian Application No. 2015126797/03(041703), dated Nov. 14, 2017, with English Translation.

* cited by examiner

A - A

A - A

A - A

B–B

D-D

E-E

ARRANGEMENT AND METHOD FOR INTRODUCING HEAT INTO A GEOLOGICAL FORMATION BY MEANS OF ELECTROMAGNETIC INDUCTION

CROSS-REFERENCE TO RELATED APPLICATIONS

The present patent document claims the benefit of PCT/EP2013/074457, filed on Nov. 22, 2013, EP12195930.8, filed on Dec. 6, 2014 and EP12195958.9, filed on Dec. 6, 2014, which are hereby incorporated by reference in its entirety.

TECHNICAL FIELD

The present embodiments relate to introducing heat into a geological formation, in particular introducing heat into a deposit present in a geological formation in order to recover a hydrocarbon-containing substance (e.g., crude oil) from the deposit, where the deposit is opened up for development by shafts, day drifts, galleries or other mine workings. The present embodiments further relate to the recovery of viscous, highly viscous and bitumen-like crude oils.

BACKGROUND

It is known to extract high-viscosity and bitumen-like crude oils (e.g., oil sands) by strip mining. This method is frequently put into practice in regions where such deposits have been developed or are covered by less than 75 meters of sediment.

For underground deposits, starting from a depth of about 75 meters, use is frequently made of "in situ" methods. With this technique, the oil sand (e.g., the sand and the rock with the oil contained therein) remains in place within the original formation. The oil or bitumen is separated from the sand grain by various processes and is made more flowable so that it may be extracted. The general principle underlying the "in situ" methods is to increase the temperature in the subsurface, thereby lowering the viscosity of the bound oil or bitumen and making the bound oil or biumen more flowable so that it may subsequently be pumped out. The effect of the heating action is to split up long-chained hydrocarbons of the highly viscous bitumen.

Well-known methods based on "in situ" methods are SAGD (steam assisted gravity drainage), CSS (cyclic steam stimulation), THAI (toe to heel air injection), VAPEX (vapor extraction process), etc.

The most widespread and applied "in situ" method for recovering viscous oils and bitumen is the SAGD method. For example, with this technique, steam is forced in under pressure through a well running horizontally within the reservoir, the well being equipped for that purpose with a special slotted injection pipe. The heated, molten bitumen/heavy oil, having been separated from the sand or rock, seeps to a second slotted pipe (e.g., the production pipe) that has been introduced into a horizontal well located roughly 5 meters deeper (e.g., the distance between injector and production pipe, depending on reservoir geometry) and through which the liquefied bitumen/heavy oil is conveyed. During this process, the steam fulfills a number of tasks simultaneously (e.g., introducing the heating energy to achieve the liquefaction, separating the bitumen/oil from the sand, and building up the pressure in the reservoir in order to make the reservoir technically permeable to allow the bitumen to be transported (permeability) and to enable the bitumen to be extracted).

In the SAGD method, two technological phases are typically to be performed in succession: a steam circulation phase over several months; and followed by a production phase (e.g., SAGD phase), where the steam injection is continued.

While the aforementioned methods are provided for permeable sands, there are also oil deposits where high-viscosity oils and bitumen are trapped in low-permeability or partially permeable rock, or trapped in alternating layers of permeable and non-permeable rock, such that exploitation by mining techniques is conceivable.

Oil recovery using mine workings is known from U.S. Pat. No. 4,458,945. As well as the operation explained therein (e.g., oil is conducted away by pipes), it is also mentioned that in order to enhance recovery of the oil, it would be possible to utilize radio waves or microwaves that penetrate into an oil sand stratum to increase the flowability of the oil.

A method for oil recovery using mining techniques is known from the abstract of Patent Application No. RU2268356, where steam is injected from a mine tunnel (e.g., shaft) into a zone in order subsequently to extract oil.

If steam or hot water is used as a heat-carrying medium in order to recover crude oil by shaft mining, the following disadvantages may result: a possibility of steam breakthrough into the mine workings, which leads to the loss of the heat-carrying medium and jeopardizes operational safety; high investment and operating costs that result from building/purchasing and operating the steam production facilities; and high overheads for separating the oil-water mixture and high overheads for treatment of the water produced.

SUMMARY AND DESCRIPTION

The scope of the present invention is defined solely by the appended claims and is not affected to any degree by the statements within this summary. The present embodiments may obviate one or more of the drawbacks or limitations in the prior art.

For example, the present embodiments may provide an arrangement for shaft mining where the above-cited disadvantages occur to a lesser extent. The present embodiments may also enable the degree of oil recovery from the deposit to be increased.

The present embodiments relate to an arrangement for introducing heat into a geological formation. For example, heat is introduced into a deposit present in a geological formation (e.g., in the subsurface) in order to recover a hydrocarbon-containing substance (e.g., crude oil) from the deposit, where at least one subterranean mine working has been driven in the geological formation by underground mining techniques and the mine working includes at least one shaft and/or at least one gallery. The construction of the mine working by underground mining techniques is provided for shaft mining or deep mining. In addition, an electrical conductor is at least partially introduced in the geological formation, the conductor extending in a first conductor piece within the mine working. The conductor includes at least one conductor section, such that during operation, an electromagnetic field acts by electromagnetic induction on the ground adjacent to the conductor section to increase temperature and decrease viscosity of a substance present in the adjacent ground. The heated substance is a hydrocarbon-containing substance (e.g., crude oil present in the subsurface). A second conductor piece of the conductor is also arranged in a borehole in the ground.

The expression "introducing heat" is to be understood as a process of applying heat or achieving an increase in temperature so that a higher temperature is established within the deposit.

The increase in temperature has an impact on organic substances in the adjacent ground. Furthermore, the increase in temperature is produced as a result of the electromagnetic field causing eddy currents to form by induction in electrically conductive strata of the ground. The eddy currents generate Joule heat that brings about an increase in temperature, thus lowering of the viscosity of the substance present in the ground.

Providing mine workings (e.g, shafts, galleries and day drifts) is used when there are at least fractions of solid rock strata present in the subsurface formation. The strata are at least sufficiently stable to allow mine workings to be introduced (e.g., a process described in the technical terminology as "driven") without difficulty.

The term "day drift" is to be understood as a mine working that is largely horizontal or slightly upwardly inclined, where the day drift begins at the ground surface.

The term "gallery" is to be understood as a mine working that is largely horizontal or slightly upwardly inclined, where the gallery does not necessarily begin at the ground surface, but may also be completely in the subsurface.

Galleries and day drifts are generally underground passages. Galleries and day drifts may have at least one cross-section enabling personnel, equipment or excavated earth to pass through the gallery or the day drift. A borehole for a pipe is not to be understood as a gallery or day drift.

The term "adjacent" ground is to be understood as the immediately surrounding earth around the electrical conductor, or the earth at a distance from the electrical conductor provided that the electromagnetic field of the conductor is still effective over that distance.

The term "ground" is to be understood as sandy, possibly consolidated, cemented rock as well as solid rock, including all of the materials contained in the earth (e.g., hydrocarbon-containing, oleaginous components to be extracted).

The present embodiments, owing to already present or previously driven mine workings (e.g., shafts, galleries and/or day drifts), may allow for simplified drilling methods to be utilized in order to enable the electrical conductor to be introduced along with underground drainage lines for conveying the fluid substance (e.g., substantially consisting of crude oil and water). In an embodiment, the electrical conductor is configured as a closed, uninterrupted loop, where forward and return conductors may be connected to a frequency generator that supplies current to the electrical conductor at a frequency prescribed therefor. For example, a borehole running predominantly in a straight line may be driven for the conductor from/to the shaft or from/to the gallery. Furthermore, a borehole for a production pipe for conducting away a fluid production material may be driven from/to the shaft or gallery. A closed, uninterrupted loop may be used with injection pipes that are to be laid in order to introduce a fluid into the subsurface, where injection pipes may be installed in boreholes from or to the shaft or from or to the gallery. By incorporating shafts and galleries for boreholes, it is possible to drive largely straight, bend-free boreholes for installing the conductor. The shafts and galleries may be used for collecting, transporting and removing the production material. The frequency generator or other electronic components for operating the electrical conductor may be installed in the shafts and/or galleries. The shafts and galleries may permit a section of the conductor to be positioned in a shaft and/or gallery (e.g., along the extension of the shaft and/or gallery, or transversely through the shaft and/or gallery).

Furthermore, the shafts and galleries enable a simplified installation of the conductor in the form of a conductor loop that has two conductor sections running substantially parallel to each other, with a small radii of curvature of the conductor loop (e.g., because the curve of the conductor loop may be provided in the shaft and/or gallery). Drilling boreholes having curved radii in the ground may be avoided or, the number of curved boreholes may be reduced. A desired loop for the electrical conductor may be formed such that the electrical conductor is guided through a borehole from the frequency generator into a gallery. The gallery may be provided with a transition to a further gallery, the further gallery guided to the next borehole, and with the next borehold leading back to the frequency generator.

In an embodiment, an installation method is provided, where at least one shaft and/or at least one gallery is driven in the subsurface for a shaft mining operation. Furthermore, a borehole for a conductor is driven in which an electrical conductor is introduced at least partially into the subsurface (e.g., into the geological formation).

In an embodiment, an operating method is provided, where the conductor is operated according to an arrangement described above such that during operation, an electromagnetic field acts by electromagnetic induction on the ground adjacent to the conductor section causing an increase in temperature and a decrease in the viscosity of the substance present in the adjacent ground.

In this embodiment, eddy currents are formed in the electrically conductive strata by electromagnetic induction, the eddy currents generating Joule heat.

According to an embodiment, an electrical conductor is used, that during operation is surrounded in a targeted manner by an electromagnetic field with the result that the surrounding ground is heated by electromagnetic induction. However, this is not to be understood as meaning that any parasitic effects that occur in many electrical conductors during operation result. According to an embodiment, the electromagnetic induction takes place above a threshold below which induction processes occur as side-effects.

The term electromagnetic induction is to be understood as neither resistive heating nor microwave heating. However, specific devices for producing resistive or microwave heating may be used in addition to the present embodiments.

According to an embodiment, a first conductor piece of the conductor is arranged in the at least one shaft and/or in the at least one gallery. In the first conductor piece, the conductor has no direct physical contact with the ground and is not directly enclosed by the ground. The first conductor piece may come to rest freely in the shaft or gallery. As a result, a small curvature radii of the conductor is possible. Furthermore, access to the conductor by installation or operating personnel is possible.

In an embodiment of the arrangement and of the method, at least one borehole is provided for the installation of the electrical conductor that may have a curved section and a quasi-horizontal section. The borehole may end in the mine working.

According to an embodiment, a second conductor piece of the conductor is arranged in a borehole in the ground. The second conductor piece may be in contact with the ground. If the second conductor piece is in contact with the ground, the second conductor may be sheathed and/or the borehole may be lined with pipe so that the transition of the conductor to the surrounding ground is effected by the sheathing, the pipe and/or cavities in the ground. It is to be understood said that the transition is not a thermal or electrical transition between conductor and ground, but only a surrounding field of the conductor.

The contact of the second conductor piece with the ground is either direct or indirect, by components that cylindrically enclose the conductor.

However, a direct contact between conductor piece and ground is not necessary for the operation. It is sufficient that the conductor piece pass through the ground or be introduced into the ground without an electromagnetic field of the conductor piece being shielded. It is understood that the following arrangement in the ground, or a passing through the ground, is not merely the placement or running of the conductor in the mine working.

In the embodiment of an indirect contact of the conductor piece with the ground, the conductor may be drawn in a non-metallic tube. For this embodiment, the conductor is not directly in contact with the ground, but is in contact with the enclosing tube. The tube is in contact with the ground, and small surrounding cavities may also be present here. Indirect contact is between conductor and ground.

Furthermore, the conductor may be installed in the tube such that the conductor does not touch the tube (e.g., by spacers between conductor and inner surface of the tube).

The contact or non-contact of the conductor with the ground has no direct impact on the electrical function, but does permit a distinction between whether a conductor section is laid in a borehole (e.g., contact between conductor and ground) or in a mine working.

To ensure an uninterrupted effect of the electromagnetic radiation from the electrical conductor into the ground, the conductor is installed without being enclosed in tubing. Alternatively, a non-metallic tubing may be used. In addition, a sheathing of the conductor may consist of non-metallic material.

Two substantially parallel boreholes may be drilled between two substantially parallel (e.g., quasi-parallel) galleries, and the conductor may be drawn into the parallel galleries and the parallel boreholes such that the conductor forms a conductor loop. This may be carried out such that a conductor loop may be installed largely horizontally with a first conductor section in a first borehole. The first borehole may end in a first gallery running largely at right angles thereto, and the conductor loop may be installed largely horizontally with a second conductor section in a second borehole. The second borehole may end in the first gallery running largely at right angles thereto, and the conductor loop may comprise a third conductor section that may be arranged in the first gallery and may provide a connection between the first conductor section and the second conductor section.

The first conductor section may be routed by the first borehole or by the at least one shaft to the ground surface. The second conductor section may be routed by the second borehole or by the at least one shaft to the ground surface. Accordingly, a frequency generator installed at the surface for the purpose of supplying current to the electrical conductor may be connected to the conductor.

Furthermore, a conductor loop may be joined together and/or closed in a mine working (e.g., in a second gallery). The conductor loop may be joined by the two conductor ends being brought into immediate proximity of each other in order to be able to be connected to a frequency generator. This may be implemented such that the first conductor section ends at the end opposite the first gallery by the first borehole in a second gallery running largely at right angles to the first borehole, and that the second conductor section ends at the end opposite the first gallery by the second borehole in the second gallery running largely at right angles to the second borehole. At least one fourth conductor section of the conductor loop (e.g., preferably two fourth conductor sections) is arranged in the second gallery. In this arrangement, the two fourth conductor sections preferably converge on one another from opposite directions.

The frequency generator and/or further electronic components to operate the electrical conductor may be arranged at the surface (e.g., above ground). At least one fifth conductor section of the conductor loop may be arranged in a vertical borehole originating from the second gallery or a vertical shaft originating from the second gallery, and the at least one fifth conductor section may provide a connection to a frequency generator. The term "vertical" as used in this context is to be understood that, for example, a vertical borehole or a vertical shaft has a vertical vector component that is greater than a horizontal vector component of the borehole or shaft. In an implementation, the horizontal vector component is zero such that a perfectly vertical orientation is established. The fifth conductor section may run substantially vertically or obliquely with respect to the surface.

Furthermore, boreholes and pipes installed therein may be provided through which the substance may be extracted or through which water in liquid form or as steam (e.g., optionally with the addition of further components such as electrolytes) may be injected. This may be realized such that between two conductor sections arranged at a first depth and running substantially parallel there is arranged parallel thereto an injection pipe for feeding into the deposit a fluid that is to be injected and/or a production pipe (e.g., a collector pipe) for discharging a fluid extracted from the deposit. The pipes may be slotted or otherwise permeable such that liquid and/or gas (e.g., possibly including smaller solids) may enter or exit.

The fluid to be injected may be fed to the injection pipe by at least one mine working (e.g., a shaft, a gallery and/or a day drift). The extracted fluid may be discharged and/or collected from the production pipe by at least one mine working.

In another embodiment, an injection pipe and/or a production pipe may be arranged within the first borehole in addition to the conductor or, after removal of the conductor, alternatively to the conductor. Furthermore, an injection pipe for feeding into the deposit a fluid that is to be injected, and/or a production pipe for discharging a fluid extracted from the deposit, may be arranged within the second borehole in addition to the conductor or, after removal of the conductor, alternatively to the conductor.

A frequency generator for driving the conductor may also be provided. The frequency generator may be arranged at the ground surface or in the mine working.

In a below-ground installation of the radiofrequency generator, ends of the conductor may be connected in an explosion-protected and/or weatherproof terminal box that may be self-contained and sealed off in an explosion-proof manner from the frequency generator.

With regard to the provision of or driving of the mine workings, two of the one or more shafts or galleries may be arranged so as to be quasi-parallel. Furthermore, the at least one gallery (e.g., or both of the said two galleries) may be arranged in the striking direction of an oil-bearing stratum.

One or more of the boreholes provided for the conductor between the mine workings may be arranged in an incline of the dip line or in the floating direction of the oil-bearing stratum.

Furthermore, a first of the one or more galleries may be arranged in the roof rocks of an oil-bearing stratum and a second of the one or more galleries may be arranged in the floor rocks of the oil-bearing stratum. The mine working may be provided in an oil-bearing stratum of the deposit and/or in rocks adjoining the deposit. The provision in the adjoining rocks may be embodied in such a way that a first of the one or more galleries is arranged in the roof rocks of an oil-bearing stratum and that a second of the one or more galleries is arranged in the floor rocks of the oil-bearing stratum.

Furthermore, to enable an enhanced recovery of the substance, there may also be arranged between two quasi-parallel boreholes provided for the conductor and at least two further quasi-parallel boreholes in the oil-bearing stratum with a fissure lying therebetween.

Furthermore, in addition to the structural arrangement, an embodiment includes the construction steps necessary therefor (e.g., the drilling of boreholes, the excavation, drilling and driving of shafts and galleries, including required static stabilization measures, the introduction of the conductor into the boreholes or mine workings (e.g., galleries, shafts, etc.) Furthermore, the operating methods for the arrangements described hereintofore are also included in an embodiment. This applies to the powering of the conductor installed in the subsurface through application of alternating voltage to the conductor (e.g., to recover the hydrocarbon-containing substance.

In the method for introducing heat into a geological formation (e.g., into a deposit present in a geological formation), in order to recover a hydrocarbon-containing substance (e.g., bound crude oil) in an above-described arrangement, to provide an increase in temperature of a heated zone of up to 120-140° C. accomplished by the energized conductor, the heated zone may be flooded with an aqueous fluid medium comprising water and at least one glucan having a β-1,3 glycosidically linked backbone chain and β-1,6 side chains glycosidically bound thereto. In this case the glucan may have a weight-average molecular weight of $1.5\times10^6$ to $25\times10^6$ g/mol.

A first embodiment relates to a method for recovery of crude oil by shaft mining, wherein the deposit is suitable for development by mining techniques, the vertical or inclined shafts/day drifts may be sunk and the galleries may be driven as mine workings, at least two boreholes may be drilled in the oil-bearing strata, the electric cables that form the induction loop may be laid in the boreholes, the deposit may be inductively heated, and the crude oil may be extracted at reduced viscosity, wherein at least one mine working may be driven in the oil-bearing stratum or in the rocks adjoining the oil-bearing stratum, and at least two boreholes having quasi-horizontal, quasi-parallel sections may be drilled from one side (e.g., from the surface) up to the boreholes' intersection with the mine working, wherein the axes of the quasi-horizontal well sections may be oriented quasi-vertically to the axis of the mine working and the electric cables may be laid in the two boreholes as well as in the mine working with formation of a loop.

In particular, the boreholes may be drilled in at least two rows, the borehole rows may be positioned to the left and right of the mine working axis, and the mine working may be intersected on both sides with quasi-horizontal well sections.

Furthermore, the inductor may be supplied with power until the temperature of the heated zone in the reservoir is increased to up to 120° C. or up to 140° C. After this increase in temperature of the heated zone, the heated zone may be flooded with aqueous fluid medium. In addition to water, said fluid medium may include at least one glucan (G) having a β-1,3 glycosidically linked backbone chain and β-1,6 side chains glycosidically bound thereto, wherein the glucan may have a weight-average molecular weight of $1.5\times10^6$ to $25\times10^6$ grams per mole (g/mol).

An inductively heated zone between two horizontal boreholes may be flooded with an aqueous urea solution that contains 5 to 35% urea (by weight), wherein the flooding with aqueous urea solution begins after the zone has been heated to 70°-300° C.

The flooding of the inductively heated zone may begin after the temperature 70-140° C. has been reached (e.g., determined in said heated zone). Further heating of the zone may be adjusted during the flooding of the heated zone. At the same time, the induction loop may be removed from the boreholes and one horizontal borehole may be used as an injector and the other horizontal borehole as a producer well.

Furthermore, while the heated zone is being flooded, the heated zone may continuously be heated further. The flooding and/or the oil recovery may be carried out through supplementary boreholes drilled from the surface or from the mine working into the heated zone.

In addition, at least two additional horizontal boreholes may be drilled in the direction of the mine working without traversing the mine working, wherein said two boreholes may be used for supplying the heated-up zone with steam (e.g., water vapor).

In this embodiment, the mine working may be driven outside of the action zone of the steam chamber.

In one embodiment, the flooding medium may be injected into the deposit from the mine working.

Further, a first horizontal borehole may be used as an injector and another horizontal borehole as a producer well.

In another embodiment, at least one mine working may be driven in the oil-bearing stratum or in the rocks adjoining the oil-bearing stratum, and the boreholes may be drilled from one side with quasi-horizontal, quasi-parallel sections up to the intersection with the mine working, wherein the axes of the quasi-horizontal well sections may be oriented quasi-vertically to the axis of the mine working and the electric cables may be laid in the two boreholes as well as in the mine working (e.g., thereby forming a loop).

Further, the quasi-horizontal well sections may be drilled principally in the water-bearing strata located below or within the oil-bearing stratum. The water-bearing strata may be heated inductively during operation, with the oil-bearing stratum being heated by transfer of thermal energy from the water-bearing strata to the oil-bearing stratum.

In another embodiment, the boreholes may be drilled in at least two rows, wherein the borehole rows may be positioned to the left and right of the mine working axis and the mine working may be intersected from both sides with quasi-horizontal well sections.

In an embodiment, a frequency generator may be provided that feeds the inductor loop at a frequency between 1 kHz and 500 kHz. In a variation of an embodiment, the frequency generator may be configured in an explosion-protected form.

The frequency generator may be stationed in the mine working.

Furthermore, the ends of the induction loop may be connected in a specially arranged, separate explosion-proof terminal box that is self-contained and sealed off in an explosion-proof manner from the frequency generator.

The frequency generator may be implemented as an inverter with power semiconductors. The inverter with power conductors may be water-cooled and recooled via the mine drainage water by a heat exchanger.

In a further embodiment, if no recooling medium is provided, a heat pipe or thermosiphon may be installed that inherently permits explosion-proof cooling and operates independently of an external cooling medium.

The inverter may furthermore be provided in a containerized, weatherproof form, and with the power components mounted in a shockproof manner.

In an embodiment, a method is provided for crude oil recovery by shaft mining, wherein the deposit may be developed by mining techniques, the vertical or inclined shafts/day drifts may be sunk and the galleries may be driven as mine workings, the boreholes may be drilled in the oil-bearing strata, the electric cables that form the induction loop may be laid in the boreholes, the deposit may be inductively heated, and the crude oil may be extracted at reduced viscosity, wherein at least two quasi-parallel mine workings may be driven in the oil-bearing stratum or in the adjoining rocks, at least two continuous quasi-parallel boreholes may be drilled between the mine workings, the induction loop may be laid in the boreholes, in which case the start section and the end section of the induction loop may be arranged in one mine working and a part of the induction loop may be laid freely in the other mine working between two borehole entries.

It may furthermore be provided that the mine working in which the start section and the end section of the induction loop are arranged may be connected to above ground by a quasi-vertical borehole. Sections of the induction loop or electric feeder cables for connecting the induction loop to the frequency generator or the electrical energy source may be laid in said borehole.

The electrical conductor may be an induction cable so that the electrical conductor may carry the radiofrequency current (e.g., driven in a low-loss manner as a resonant circuit). Because both ends are connected to the frequency generator, the induction cable forms an induction loop. In this embodiment, the electric cable is implemented as a resonant circuit.

The frequency generator may be a frequency inverter that converts a voltage having a frequency of 50 Hz or 60 Hz from the power grid into a voltage having a frequency in the range of 1 kHz to 500 kHz. The frequency inverter may be installed above ground. Alternatively, the frequency inverter may be placed in a mine working.

The two quasi-parallel mine workings may be driven at different depths. The start section and the end section of the induction loop may be arranged in the mine working that is located higher than the second mine working.

In one embodiment, at least one non-continuous producer well may be drilled from one mine working between two continuous quasi-parallel boreholes in which sections of the induction loop are laid, said non-continuous producer well connecting the heated deposit zone with one of two quasi-parallel mine workings.

Furthermore, at least one producer well may be drilled into the deposit zone heated by the induction loop.

In addition, at least one non-continuous injection well may be drilled from one mine working between two continuous quasi-parallel boreholes in which the induction loop is arranged.

In one embodiment, the continuous boreholes in which the returning or the supplying electric cable of the induction loop are laid may be used as production wells. In this embodiment, the borehole may be used simultaneously or in succession for the induction loop and for transporting and removing the production.

Thus, for example, the borehole from which the electric cable has been removed may be used as a production well.

Additionally, it may be provided that the borehole from which the electric cable has been removed is used as an injection well.

Furthermore, after the deposit zone between two continuous quasi-parallel boreholes has been heated, the returning or the supplying electric cable of the induction loop may be removed from one borehole and laid in an adjacent continuous borehole.

The orientation of the boreholes is determined according to the geological conditions. The two quasi-parallel mine workings may be driven in the striking direction of the oil-bearing stratum and the continuous boreholes drilled in the dips or in the floating direction of the oil-bearing stratum.

Furthermore, one mine working may be driven in the roof rocks of the roof rocks of the oil-bearing stratum and the second mine working in the floor rocks of the oil-bearing stratum.

The oil deposit may be developed by slice mining and in the opposite direction to the dip line (e.g., rising extraction), wherein two quasi-parallel mine workings may be driven for each slice.

In addition, at least another two continuous quasi-parallel boreholes may be drilled in the oil-bearing stratum between two continuous quasi-parallel boreholes and a fissure may be formed between the additional boreholes.

In this embodiment, continuous fissures may be formed between additional boreholes by a drag-type cutter device.

In a further embodiment, the mine workings may be driven in at least two producing zones, cut-throughs may be driven between the mine workings in each producing zone, and the cut-throughs may be connected to one another by continuous boreholes that are drilled in the oil-bearing stratum.

In an embodiment, a method is provided for constructing the arrangement for introducing heat into a geological formation discussed above (e.g., introducing heat into a deposit present in a geological formation in order to recover a hydrocarbon-containing substance from the deposit), wherein at least one subterranean mine working is produced in the geological formation by underground mining techniques and the produced mine working comprises at least one shaft and/or at least one gallery. An electrical conductor is introduced at least partially in the geological formation. The conductor is installed in a first conductor piece within the mine working. Furthermore, the conductor has at least one conductor section that is provided such that during operation an electromagnetic field acts by electromagnetic induction on the ground adjacent to the conductor section to bring about an increase in temperature and thereby to reduce the viscosity of a substance present in the adjacent ground. Furthermore, a second conductor piece of the conductor is arranged in a borehole in the ground such that the second conductor piece is in contact with the ground.

Accordingly, a method for producing a mine working, for drilling boreholes in order to install a conductor, and for installing the conductor is provided.

In particular, the method may be embodied in such a way that the at least one borehole is drilled in a curve in at least one section. Furthermore, a quasi-horizontal section may be drilled, the drilling being terminated in the mine working so that the borehole ends in the mine working.

In one embodiment, a conductor loop may furthermore be laid in boreholes and mine workings. In particular, the conductor loop may be laid largely horizontally with a first conductor section in a first borehole. Furthermore, the conductor loop may be laid largely horizontally with a second conductor section in a second borehole. The first borehole and the second borehole preferably end in a first gallery running largely at right angles thereto. The conductor loop may therefore have a third conductor section which is arranged in the first gallery and by which a connection is provided between the first conductor section and the second conductor section.

The previous embodiment variants may be directed to heating for the purpose of extracting crude oil or other carbonaceous substances present in the deposit. However, the method according to other embodiments may be utilized in other environments or fields of application, such as coal mining, tunnel building and/or construction. For example, the recovery of metals from ore deposits may be assisted by the heating of substances that are capable of being stimulated or excited by induction.

In-situ leaching is a well-known and widely employed technology in the recovery of many metals (e.g. uranium, gold, copper, cobalt). According to this technology, different aqueous solutions (e.g., weak sulfuric acid solution) are injected into the deposit. The solutions filter through the porous or fissured rocks/ores. The oxidizing solution mobilizes the metals, and the efficiency of the mobilization and/or of the extraction being very much dependent on the temperature of the deposit and/or the solution. The use of the described facility enables the temperature to be increased directly in the ore deposit, thereby reducing the extraction time and increasing the rate of yield.

Tunnel building and construction (above ground) are often confronted with drift sand and/or running sand and other geological objects that are gone to water and unstable. These geological objects make it difficult to construct the underground mine workings and have a negative impact on the stability of the structures built above ground. The use of the described facility enables the rheological properties of the drift sands and/or running sands and other unstable geological structures to be modified by introducing heat into such geological objects.

DETAILED DESCRIPTION

The figures depict an oil deposit (referred to hereinbelow as a reservoir, a production layer or merely as a deposit) containing highly viscous crude oil or bitumen or heavy oil (e.g., having a dynamic viscosity, such as a flow resistance of 200 to 1000000 cP, where cP stands for centipoise, and where the cited values correspond to 0.2 to 1000 $Ns/m^2$ in the SI system) that lies at a depth (e.g., in mining parlance also referred to as the vertical depth) of 50 to 1200 meters below the surface of the earth. In the figures, this oil deposit has been or is to be developed by underground mining techniques (e.g., developed for mining by mine workings and comprises shafts and galleries). In this embodiment, the shafts and galleries are dimensioned for access by personnel and for importing and exporting material. A shaft is to be understood a mine working in an underground mining environment by which the deposit is developed from the surface (e.g., above ground).

Shafts serve for transporting personnel and material. In addition, shafts may be used for the recovery of mining products (e.g., the hydrocarbon-containing substance that is to be extracted, in particular crude oil) as well as for the mine ventilation system or fresh air supply. In the disclosed embodiments, a shaft is dimensioned significantly larger than a diameter of a current-carrying conductor by which an electromagnetic field is to be built up in the subsurface during operation. A shaft extends vertically or inclined to the vertical into the subsurface (e.g., into the geological formation). A gallery, is to be understood a mine working in an underground mining environment that is a largely horizontal or slightly inclined cavity extending in an elongate manner and that adjoins the deposit or passes through the deposit. Galleries may be connected to other galleries and are ventilated by the shafts.

Figure 1:
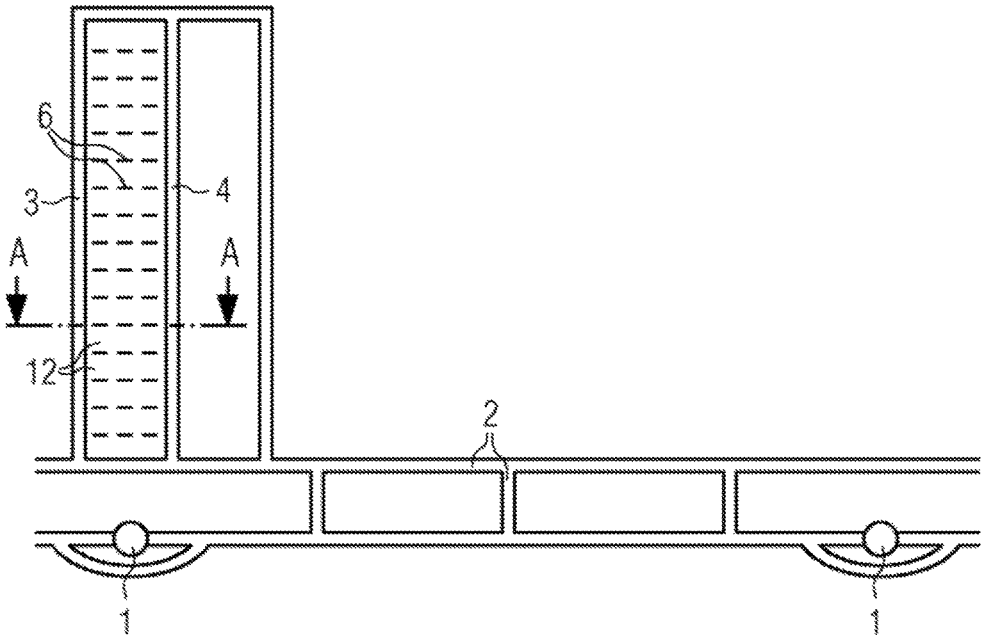
FIG. 1 depicts a schematic of an oil deposit developed by underground mining techniques in a plan view.

FIG. 1 depicts a schematic of a simplified layout of a simple mine working as a cross-section in a plan view. Two shafts 1 are provided for the purpose of establishing a connection to the surface. Galleries 2, 3, and 4 are also provided in the plane shown. The galleries 2 are present below ground to provide access in the deposit. The galleries 3 and 4 are largely parallel galleries that enclose or penetrate a potential oil-bearing stratum. As deposit block 12, the surrounding area may be described as a deposit according the disclosed embodiments and comprise fractions of crude oil. In order to provide said mine working, the vertical or inclined shafts 1 are sunk into the subsurface (e.g., driven into the subsurface by underground mining techniques). In addition, the galleries 2, 3, and 4 are provided as a further mine working in the subsurface. The mine workings (i.e., the shafts 1 and the galleries 2, 3, and 4) are positioned or driven in rocks adjoining oil-bearing strata or directly in the oil-bearing stratum. Conventional underground mining equipment and machines are used for this purpose. The mine workings may be used for ventilating the mine working network (e.g., for supplying air, as well as for transporting the materials and the crude oil that is to be extracted).

In an embodiment of the invention depicted in FIG. 1, two substantially parallel galleries 3 and 4 are provided in the subsurface. In this embodiment, the galleries 3 and 4 may extend horizontally or may be inclined. The galleries 3 and 4 are constructed or driven in the oil-bearing stratum or in the adjoining rocks (e.g., adjacent to the oil-bearing stratum).

Between the galleries 3 and 4, at least two continuous quasi-parallel boreholes 6 are drilled, into which the electric cable may be run.

According to FIG. 1, the continuous quasi-parallel boreholes 6 are drilled underground starting from a gallery (e.g., gallery 3) and end in a further gallery (e.g., gallery 4). Conventional mobile drilling rigs for underground mining may be used for this purpose. The costs of producing the boreholes 6 are substantially lower than the potential drilling costs for drilling the boreholes directly from the surface (e.g., because a straight borehole is sufficient and drilling a curve is not required).

FIG. 1 depicts a cross-section A-A transverse to the galleries 3 and 4 and along the borehole 6, and the cross-section is depicted further in FIG. 2.

The galleries 3 and 4 are arranged in the subsurface. The galleries 3 and 4 may lie in a horizontal plane (not shown) or, as depicted in FIG. 2, may be arranged at different depths. Provided between the galleries 3 and 4 are the boreholes 6 (e.g., only one borehole 6 may be seen in the section depicted in FIG. 2) such that an inductor cable may be installed therethrough. The distance between the galleries 3 and 4 may be, for example, from 20 to 1000 meters wide.

Figure 2A:
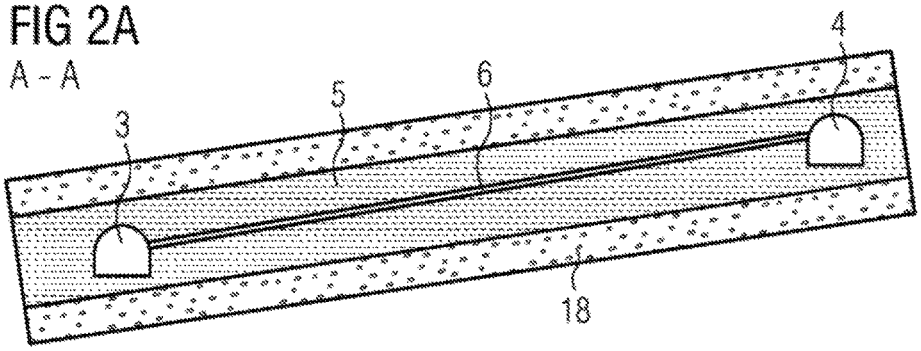
FIG. 2 depicts a vertical cross-section through an oil deposit and mine workings with a borehole for an electrical conductor.
Figure 2B:
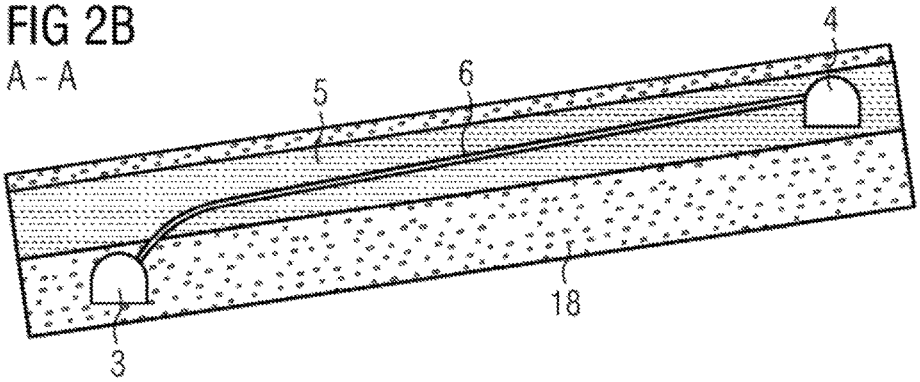
Figure 2C:
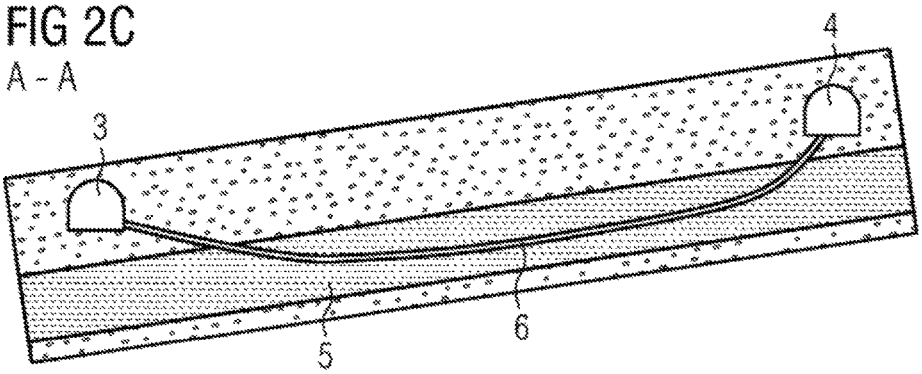

If an oil-bearing stratum 5 is formed as a flatly dipping deposit, then the two quasi-parallel galleries 3 and 4 may be arranged in the striking direction of the oil-bearing stratum 5 and the boreholes 6 may be drilled as a connection between the galleries 3 and 4 in the dipping or floating direction of the oil-bearing stratum 5 (e.g., FIG. 2A). The two quasi-parallel galleries 3 and 4 may be constructed directly in the oil-bearing stratum 5 (c.f., FIG. 2A) if the rocks of the oil-bearing stratum are stable and a precipitation of gas from the rocks of the oil-bearing stratum 5 is low, and if the oil is highly viscous and does not leak into the galleries 3 and 4 due to gravitational forces and deposit pressure. One or both of the two quasi-parallel galleries 3 and 4 may also be constructed in adjoining rocks 18 above, below or next to the oil-bearing stratum 5 (e.g., compare FIGS. 2B and 2C). The adjoining rocks are often more stable than the rocks of the oil-bearing stratum 5.

Figure 3A:
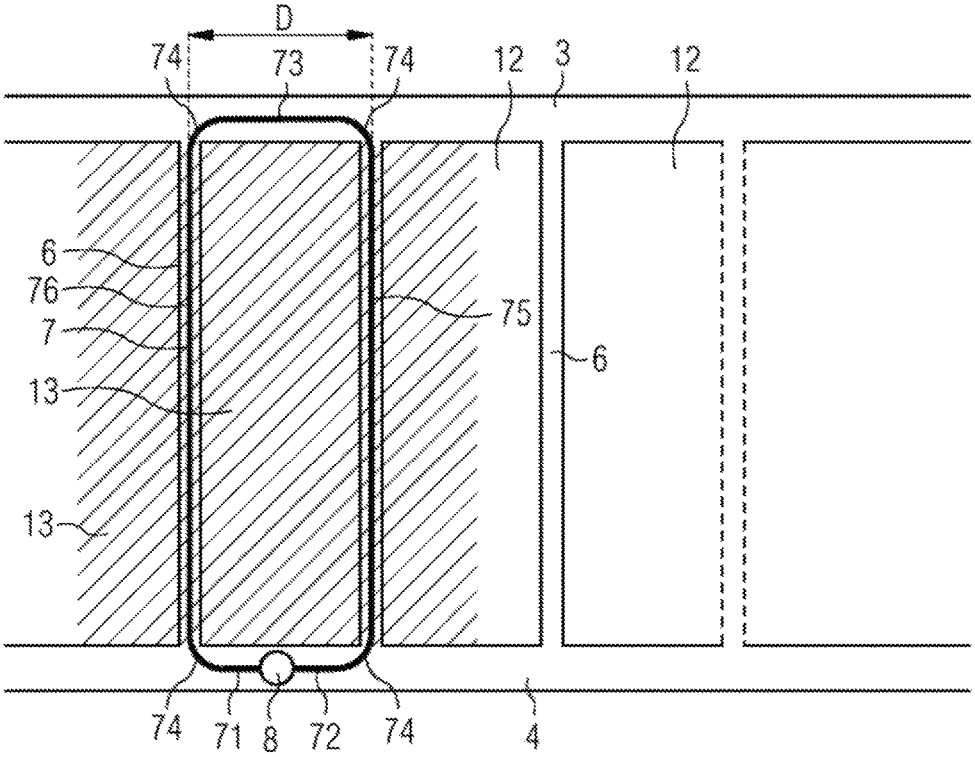
FIG. 3 depicts an oil deposit, mine workings and installed conductor, as well as the thermal effect of the energized conductor.

Referring to FIG. 3A, a schematic for an arrangement from FIGS. 1 and 2 including galleries 3 and 4 and boreholes 6 is provided in a plan view onto a largely horizontal sectional plane. An inductor cable may be installed and with which physical effects are produced during operation.

An electrical conductor 7, provided as a conductor loop, is run in two (e.g., adjacent) boreholes 6 and in sections of the galleries 3 and 4. The electrical conductor 7 is provided as an inductor and is driven during operation by alternating voltage, resulting in a build up around the conductor 7 of an alternating electromagnetic field that excites eddy currents in the naturally present electrical conductivity of the reservoir, thereby generating Joule heat (e.g., the bound oil located in the deposit block 12 or other liquids are consequently heated indirectly or directly).

The conductor 7 may consist of a sequence of inductively and capacitively acting elements forming a series resonant circuit that is provided as a loop, the ends of the conductor 7 are connected to the frequency generator that supplies power to the loop.

The electrical conductor 7 forms a conductor loop with a substantially straight start section 71 that comes to rest in the gallery 4, then is continued by a curve 74 into a predominantly straight second line section 75. This second line section 75 is routed in one of the boreholes 6. The conductor 7 is thereupon positioned in gallery 3 by a further curve 6 through a third largely straight line section 73. A transition is made by a further curve 74 to a substantially straight fourth line section 76 which comes to rest within a further borehole 6. By a further curve 74, the transition is made to the original gallery 4, in which an end section 72 of the conductor 7 is arranged. An almost completely closed conductor loop is formed in this way. A frequency generator is to be attached to the start section 72 and to the end section 71, within the gallery 4. Alternatively, as depicted in FIG. 3A, the conductor 7 may be routed through a substantially vertical borehole 8 by two further line sections that are connected to the start section 72 and to the end section 71 to the surface, or into another mining level, where the frequency generator may in turn be arranged.

In the present embodiment, the conductor 7 is laid in the largely parallel boreholes 6 explicitly provided for the conductor 7, wherein the start section 71 and the end section 72 of the induction loop of the conductor 7 are arranged in gallery 4 and may be run freely there. Furthermore, the third line section 73 of the induction loop is run freely in the gallery 3 arranged quasi-parallel to the gallery 4 between the two borehole entries of the boreholes 6.

For example, the distance between the continuous quasi-parallel boreholes 6 may lie in the range of 10 to 200 meters. Typical distances between the forward and return conductors (e.g., the second line section 75 is regarded as the forward conductor and the fourth line section 76 as the return conductor) that form the induction loop of the conductor 7 are about 5 to 60 meters at an outer diameter of the conductor 7 of about 4 to 50 centimeters.

As mentioned, the gallery 4 depicted in FIG. 3A (e.g., in which the start section 71 and the end section 72 of the induction loop are arranged) is connected to above ground by a quasi-vertical borehole 8. Electric feeder cables 10 (e.g., depicted in FIG. 8) for connecting the induction loop to the electrical energy source or the frequency generator 11 are laid in said borehole 8.

In this embodiment, the vertical borehole 8 may be provided as a shaft 1. Therefore, the electric cables 10 for connecting the induction loop may be laid in the shaft 1.

In this embodiment, the electric feeder cables 10 may be provided as an inductor. Alternatively, the electric feeder cables 10 may be provided as a low-loss cable that become an inductor that generates a considerable electromagnetic field only at the level depicted in FIG. 3A.

The frequency generator 11 or frequency inverter may also be accommodated below ground in a mine working (e.g., in gallery 4). In this embodiment, the frequency generator 11 is implemented in an explosion-protected and/or weatherproof design.

With a small deposit depth, a borehole 8 may be provided for each deposit block 12 or each conductor loop. Alternatively, a borehole 8 may be provided for many conductor loops and/or for many deposit blocks 12.

Given a suitable supply of power to the conductor 7, an alternating electrical field forms around the conductor 7, that, in the naturally present electrical conductivity of the ground surrounding the conductor, excites eddy currents and consequently (e.g., by generating Joule heat) inductively heats the ground. This heating zone 13 as surrounding ground is likewise depicted in FIG. 3A. The heating becomes established in the depicted sectional plane and in a three-dimensional volume.

As depicted in FIG. 2, the two quasi-parallel galleries or mine workings 3 and 4 may be arranged at different depths (e.g., driven to a different vertical depth) with the start section 71 and the end section 72 of the induction loop 7 arranged in the higher of the two galleries 3 and 4. The different depth position of the galleries 3 and 4 (e.g., as depicted in FIG. 2) favors the inflow of the oils heated in the deposit block 12 through the boreholes and crevices in the deeper lying mine workings, where the oil is collected and will flow onward as far as what is termed a sump (e.g., a collection point).

Because the connection of the induction loop to the electric cables 10 takes place in the higher lying and supposedly "dry" mine working in an arrangement of this type, there is an increase in reliability in terms of malfunctions in the electrical energy supply and operational safety.

Following the completion of the underground mining works for the shafts 1 and galleries 2, 3 and 4, and the drilling of at least two continuous boreholes 6 between the galleries 3 and 4, as well as after installation of the conductor 7 as an induction loop in at least two boreholes 6 and the connection of the induction loop to the frequency generator 11, the conductor 7 begins to be supplied with power, and consequently the deposit block 12 to be inductively heated. The formation of the heating zone 13 results characterized by an increased temperature.

For example, a conductor 7 may have a series inductance per unit length of about 1.0 to 2.7 μH/m (microhenries per meter length). In this example, the transverse capacitance per unit length lies about 10 to 100 pF/m (picofarads per meter length). The characteristic frequency of the arrangement is determined by the loop length and shape and the transverse capacitance per unit length along the inductor loop.

The description of the electrotechnical parameters of the inductive heating system based on an induction loop is briefly explained below.

The conductor loop or induction loop acts during operation as an induction heater for the purpose of introducing additional heat into the deposit. The active area of the conductor may be a virtually closed loop (e.g., an oval) in a substantially horizontal direction within the deposit. An end area (e.g., possibly located above ground) may follow on from the active area. The parts of the start and end area of the conductor that are located above ground may be in electrical contact with a power source (e.g., a frequency generator). The conductor is preferably provided to compensate the line inductance of the conductor section by section by discretely or continuously configured series capacitors. In this embodiment, it may be provided for the line having integrated compensation that the frequency of the frequency generator is tuned to the resonance frequency of the current loop. The capacitance in the conductor may be formed by cylinder capacitors between a tubular outer electrode of a first cable section and a tubular inner electrode of a second cable section, between which a dielectric is situated. In complete correspondence, the adjacent capacitor is formed between the following cable sections. In this embodiment, the dielectric of the capacitor is chosen such that the capacitor provides a high withstand voltage and high temperature resistance.

A telescoping arrangement of a plurality of coaxial electrodes may be provided. Other conventional capacitor designs may also be integrated into the line.

Furthermore, the entire electrode may already be surrounded by insulation. The insulation from the surrounding ground is advantageous in order to prevent resistive currents through the ground between the adjacent cable sections in particular in the area of the capacitors. The insulation furthermore prevents a resistive current flow between forward and return conductor.

A plurality of tubular electrodes may be connected in parallel. Advantageously, connecting the capacitors in parallel may be used to increase the capacitance or to increase their withstand voltage.

Furthermore, the longitudinal inductance may be compensated by predominantly concentrated transverse capacitances. Instead of introducing more or less short capacitors as concentrated elements into the line, the capacitance per unit length (e.g., which a two-wire line such as a coaxial cable or multi-wire lines provide in any case over their entire length) may also be used to compensate for the longitudinal inductances. To that end, the inner and outer conductor is interrupted alternately at equal intervals and in this way the current is forced to flow across the distributed transverse capacitances.

This embodiment of the conductor loop may be provided as a cable configuration or as a solid conductor design. However, the design is immaterial with regard to the above-described electrical mode of operation.

Further information relating to the embodiment of conductors which may also be used for the subject matter of the present embodiments may be found in DE 10 2004 009 896 A1 and WO 2009/027305 A2.

A frequency generator for driving the electrical conductor is provided as a radiofrequency generator. The frequency generator may be of three-phase design and may include a transformer-type coupling and power semiconductors as components. In particular the circuit may include an inverter impressing a voltage. For use of such a generator in accordance with its intended purpose it may be necessary to operate the generator under resonance conditions in order to achieve a reactive power compensation. It may be necessary to correctively adjust the driving frequency to a suitable level during operation.

At the surface, the following components may be present for driving the conductor. Starting from the 3-phase grid alternating voltage source (e.g., 50 Hz or 60 Hertz), a three-phase rectifier is activated (e.g., connected downstream of the generator), by an intermediate circuit with capacitor, a three-phase inverter that generates periodic square-wave signals of suitable frequency. Inductors are driven as output by a matching network composed of inductors and capacitors. However, it is possible to dispense with the matching network if the inductor is provided as an induction loop that, owing to its inductance and the capacitive coating, enables the requisite resonance frequency to be set.

The described frequency generators may be utilized as voltage-impressing power converters or correspondingly as current-impressing power converters.

The temperature in the heating zone 13 is dependent on the introduced electromagnetic power. The electromagnetic power introduced is a product of the geological and physical (e.g., electrical conductivity) parameters of the deposit, as well as of the technical parameters of the electrical arrangement (e.g., including conductor 7 and the radiofrequency generator 11). This temperature may reach up to 300° C. and may be regulated by changing the intensity of the current through the inductor loop. The temperature regulation is realized by the frequency generator 11. The electrical conductivity of the deposit may be increased by additional injection of water or another fluid (e.g., an electrolyte).

Figure 3B:
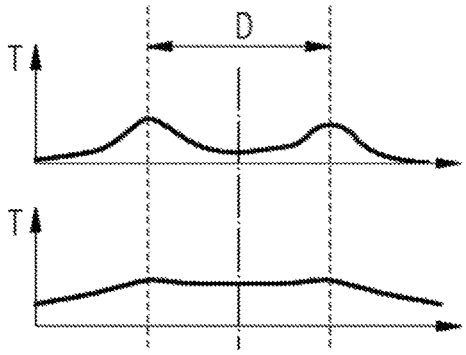

A typical temperature profile is depicted in FIG. 3B. FIG. 3B depicts the temperature T, while the abscissa is the local position in the deposit, and with the dashed lines representing the nearest points to an inductor section and the inductor sections of the forward and return conductor being arranged at the distance D. The depicted temperature profiles correspond to the arrangement from FIG. 3A. In the top diagram, the conductor 7 was driven over a period of time, with the heated fluids not having been transported and removed initially. The temperature develops initially owing to the induction of eddy currents in the electrically conductive layers of the deposit block 12. Over the course of the heating process, temperature gradients are produced, with sites of higher temperature than the original reservoir temperature (e.g., the original reservoir temperature corresponds to the zero value of the ordinate axis in the diagram). The sites of higher temperature result in those areas where eddy currents are induced. The point of origin of the heat is therefore not the induction loop or the electrical conductor, but the eddy currents induced in the electrically conductive layer by the electromagnetic field. The temperature gradients being produced over the course of time also lead to the conduction of heat as a function of the thermal parameters, such as thermal conductivity, and as a result the temperature profile is evened out. The strength of the alternating field decreases with greater distance from the conductor 7, such that only a lower level of heating is still made possible.

If the fluids, or the electrically conductive liquids made fluid, are transported and removed immediately as the fluids have been made fluid, then there is less heating by electrical eddy currents at the mined-out locations, and the more the ground with its electrical conductivity has been transported and removed. Although the electromagnetic field is actually still present, eddy currents may form only at points where conductivity is still be present. However, an outflow of one liquid may cause an inflow of another liquid to take its place.

The bottom diagram in FIG. 3B depicts the temperature curve at a time at which the extraction of the oil has already begun. The temperature in the reservoir evens out due to thermal conduction.

The design of the electrical arrangement is chosen so that the penetration depth of the electromagnetic field typically corresponds to half the distance of the horizontally embodied inductor conductors. What is achieved thereby is that there is no compensation of the electromagnetic field of a forward and return conductor of the conductor 7, and on the other side the number of boreholes in relation to the thickness of the reservoir may be kept low. In the case of the immediate evacuation of the electrically conductive liquids made fluid, the electromagnetic field reaches electrically conductive layers located further away from the inductor cable and induces eddy currents. A self-penetrating effect is provided such that the absolute power introduced into the reservoir may always be kept constant (e.g., in the range of several 100 kW to several megawatts, such as 1 megawatt). At the start, the highest specific power density is in the vicinity of the inductor cable, but when the fluids have been transported and removed, there is, in the radius lying further outside, a specific power density that, although lower, is present in a greater volume, with the absolute power introduced in fact remains the same (e.g., 1 megawatt). This may not be achieved by other electrical methods. For example, in the case of a heating rod (similar in design to an immersion heater) the power that may be introduced into the environment is always dependent on the temperature gradient as well as on the temperature-variable thermal conductivity because the heating rod is the point of origin of the temperature.

The arrangement for inductive heating of the deposit as depicted in FIGS. 2 and 3 is only one example embodiment. The number of induction loops 7 that are to be installed (e.g., that may be in operation concurrently or consecutively) is dependent on the size of the deposit. Further, the number of induction loops in operation simultaneously is dependent on the electrical power that is available.

Figure 4:
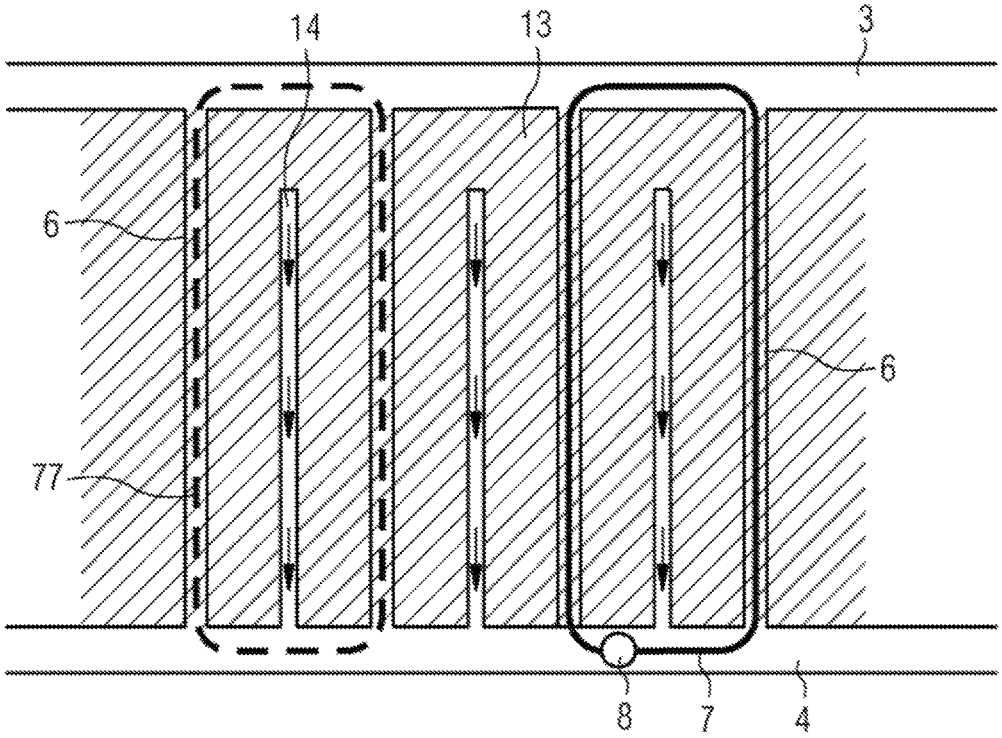
FIG. 4 depicts an oil deposit, mine workings, installed conductor and production pipes.

At least one non-continuous producer well 14 may be drilled from a mine working between two continuous quasi-parallel boreholes 6 in which the induction loop of the conductor 7 is run as depicted in FIG. 4. Non-continuous, in this context, refers to the producer well 14 as a kind of blind hole that, in contrast to the boreholes 6, starts from the gallery 4, but does not end in the gallery 3. The producer well 14 may be equipped with an extractor pipe (not explicitly identified in FIG. 4). The extractor pipe is provided for receiving, transporting and removing the now free-flowing fluid including the oil.

The number of producer wells 14 depends on the dimensions of the deposit block 12.

Also indicated in FIG. 4 is an installation of a second conductor 77 laid in two further boreholes 6, wherein the distance between the line sections of two adjacent conductors 7 and 77 nearest to one another may be at least twice the distance of the penetration depth of the alternating field.

While the conductor 7 is in operation, the crude oil flows due to reduced viscosity into the producer wells 14, or into an extractor pipe installed therein.

The flow process of the crude oil may be assisted by the injection of fluids (e.g., water, water containing additives, steam, etc.). The flooding media may be injected simultaneously into the two continuous boreholes 6 that delimit the deposit block 12. The injection of the fluids into the two continuous boreholes 6 may take place during the heating of the deposit block 12 and/or after the termination of the supplying of power to the conductor 7. During the injection process, an exit of the continuous boreholes 6 is shut off by a packer 15 as blocking element (c.f., FIG. 5). Injecting the fluids (e.g., indicated by arrows in FIG. 5) after the heating phase is particularly effective because the heavy oil, having been made highly fluid, may be displaced more easily.

Figure 5:
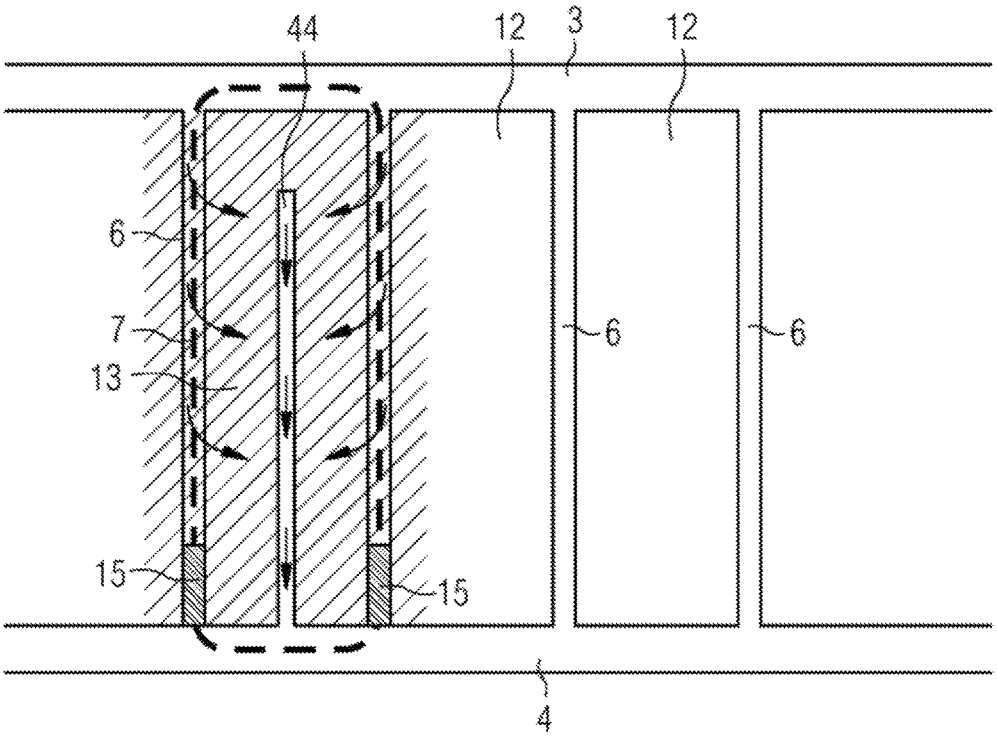
FIG. 5 depicts an oil deposit, mine workings and installed conductor with fluid injection.

Likewise, as indicated by further arrows in FIG. 5, is the transportation of the oil in the production pipe.

Figure 8:
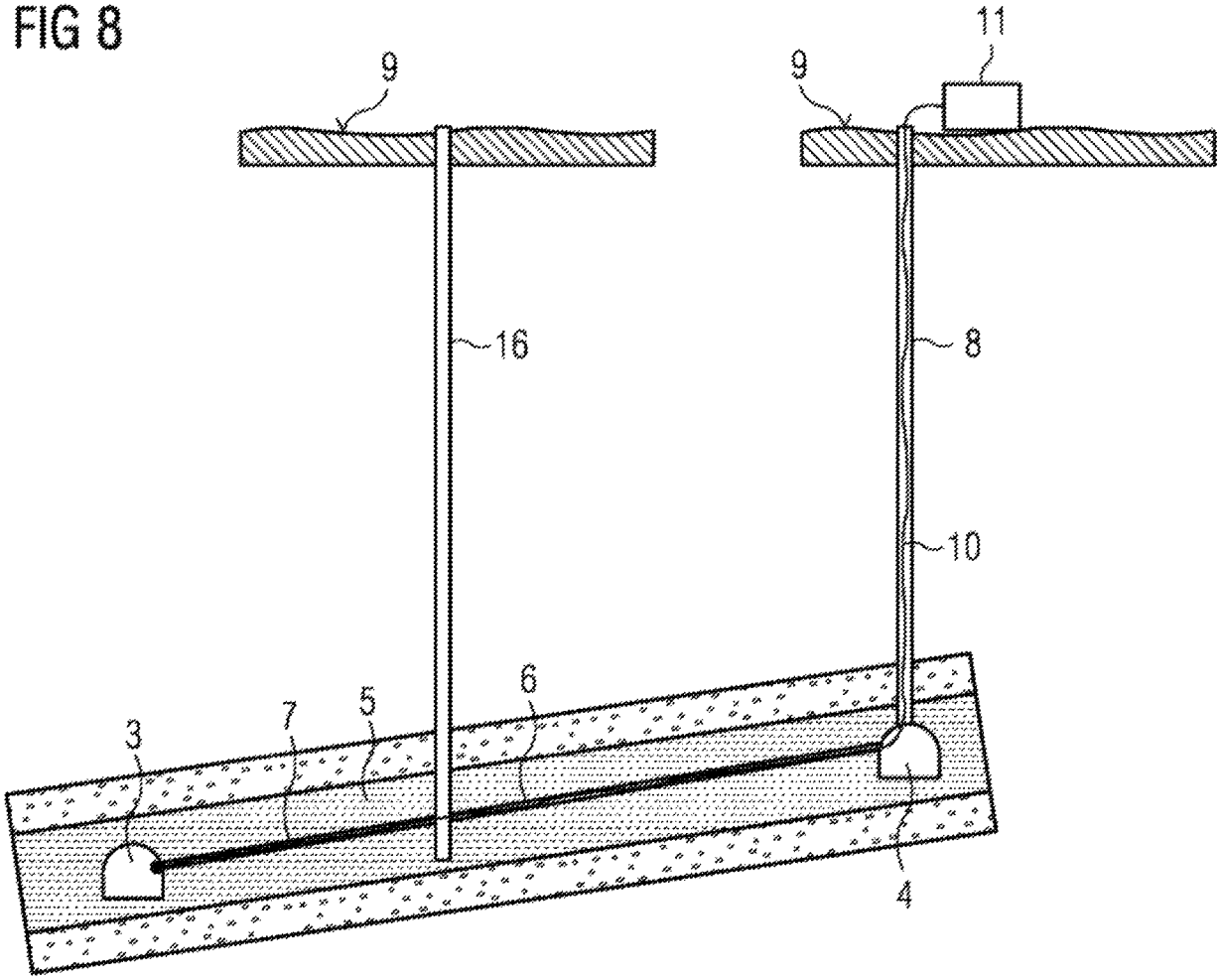
FIG. 8 depicts a vertical section through the oil deposit with installed conductor and frequency generator above ground.

In an embodiment, each deposit block 12 (e.g., given a small deposit depth) may be connected with the surface 9 by a vertical borehole 16, as depicted in FIG. 8. The borehole 16 meets the heating zone 13 in the oil-bearing stratum 5 and may be used for the flooding by a fluid or for oil recovery.

Figure 6:
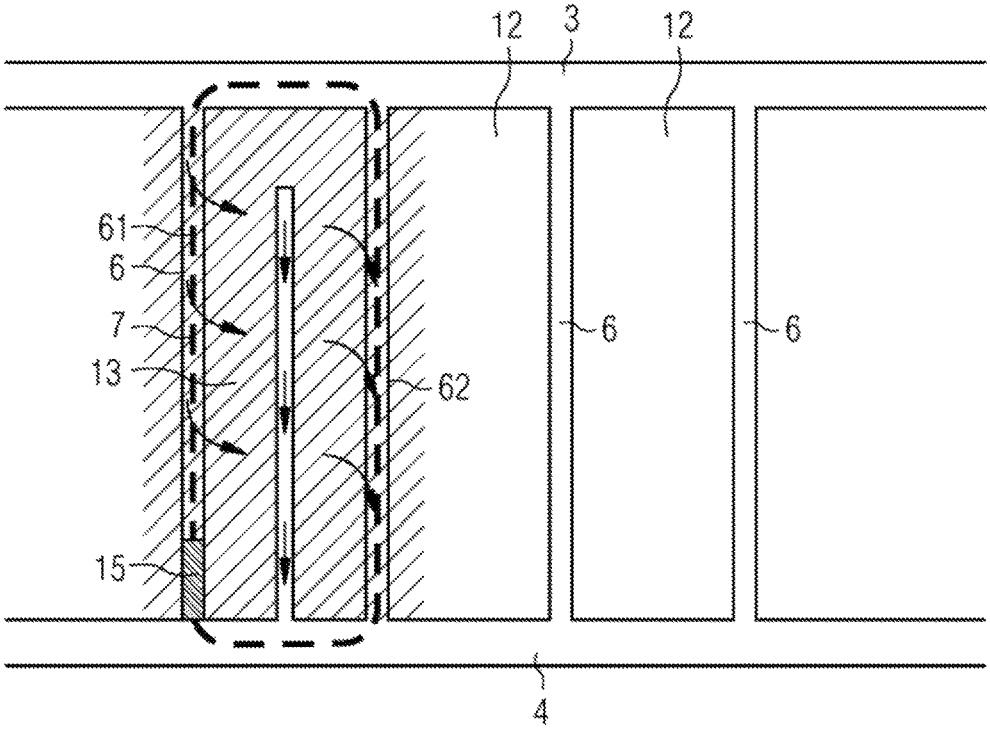
FIG. 6 depicts an oil deposit, mine workings and installed conductor with an alternative fluid injection.

According to another embodiment (c.f., FIG. 6), the heated crude oil is displaced by a fluid that is injected into only one of the continuous boreholes 6 with packer 15 and recovered through the second continuous borehole 6. As depicted in FIG. 6, only one packer 15 is provided, whereas in FIG. 5 both boreholes 6 are closed off by a packer 15 in each case. Thus, there is a borehole 6 produced that is provided as a combined installation 61 of inductor and fluid feed. Also produced is a borehole 6 that is provided as a combined installation 62 of inductor and extractor pipe.

The packer or packers 15 may be installed on the side having the higher-lying gallery 4, as depicted in the figures. However, the packer or packers 15 may be installed on the side of the lower-lying gallery 3.

Figure 7:
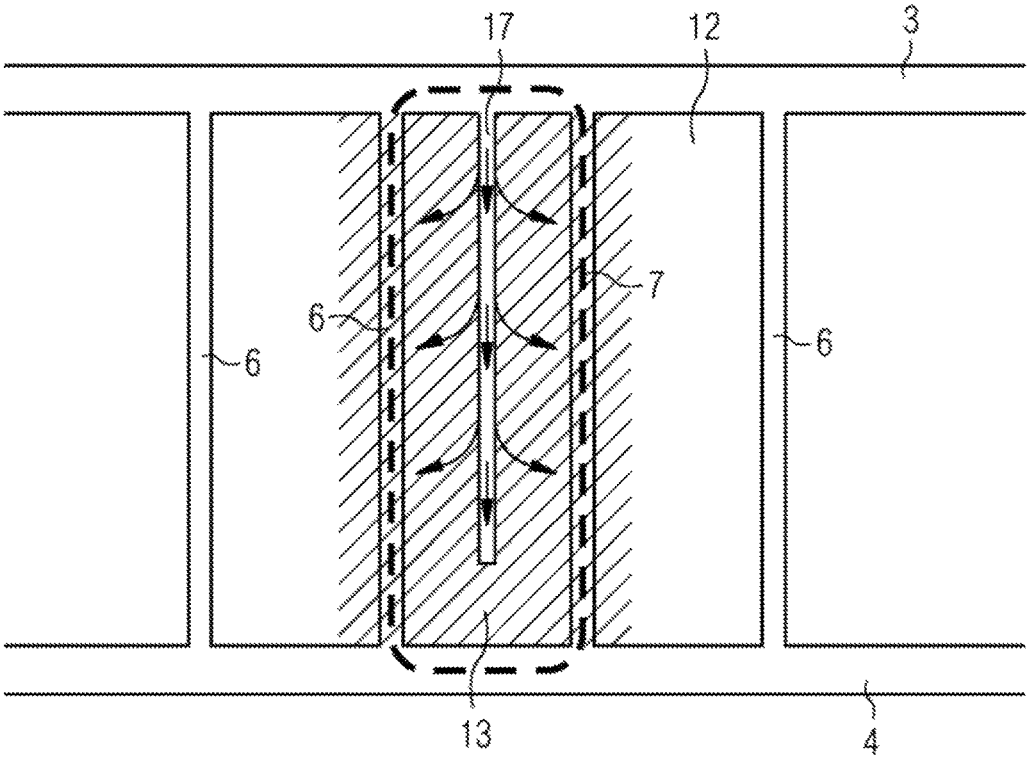
FIG. 7 depicts an oil deposit, mine workings and installed conductor with another alternative fluid injection.

According to another embodiment of the method (e.g., depicted in FIG. 7), at least one non-continuous injection well 17 (e.g., provided for an injection pipe) is drilled as a blind hole from one of the galleries 3 or 4 between two continuous quasi-parallel boreholes 6 in which the induction loop of the conductor 7 is laid or was laid at a previous time period. The forcing of the flooding media into the injection well 17 commences after the viscosity of the oil in the deposit block 12 has been reduced. This enables the continuous boreholes 6 provided for the conductor 7 to be used as production wells. The oil is displaced into said boreholes 6 and/or into additionally present production wells (e.g., corresponding to production pipe 44, as depicted in FIG. 5).

After a block 12 has been heated and a rapid increase in the oil flow capacity has been obtained, the thermal treatment of an adjacent block begins. In order to simplify the installation work, the returning or the supplying electric cable of the induction loop of the conductor 7 is removed from one borehole 6 and installed in the adjacent continuous borehole 6 (e.g., depicted by a dashed line in FIG. 4). The borehole 6 from which the electric cable has been removed may nonetheless continue to be used as a production well or injection well.

FIG. 8 is analogous to FIG. 2 and schematically depicts a lateral cross-section through a deposit, with the conductor 7 having been introduced in the galleries 3 and 4 and in the borehole 6. Furthermore, the conductor 7 is connected via the electric feeder cables 10 within the vertical borehole 8 up to the surface 9 to frequency generator 11. Optionally, the vertical borehole 16 is present, permitting a fluid to be transported from the surface to the oil-bearing stratum 5 and injected to the oil-bearing stratum 5.

In the above embodiments, the oil-bearing stratum 5 is present in a flatly dipping manner in the subsurface. In FIG. 9, an embodiment is provided in which a mine working including the galleries 3 and 4 is constructed such that the gallery 4 is built in the roof rocks of the oil-bearing stratum 5 (e.g., in the capping above the oil-bearing stratum 5) and the second gallery 3 is built in the floor rocks of the oil-bearing stratum 5 (e.g., below the oil-bearing stratum 5, c.f., FIG. 9A). The galleries 3 and 4 are driven above the oil-water interface at the same level and the oil deposit is developed by slice mining and in the opposite direction to the dip line (e.g., rising extraction). Two quasi-parallel galleries 6 may be driven for each slice (e.g., a first phase is depicted by dashed lines in FIG. 9A, and a later phase by continuous lines). This approach may be adopted primarily in the development of oil deposits/bitumen deposits having oil-bearing strata 5 of comparatively great thickness and steeply falling oil-bearing strata 5.

Figure 9B:
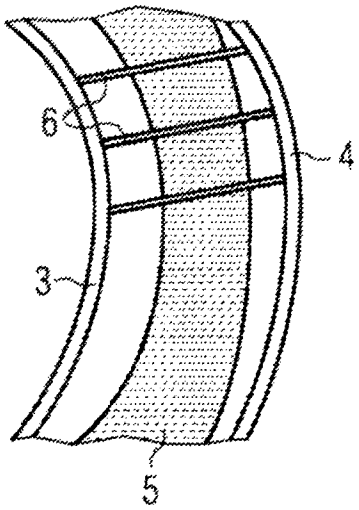
FIG. 9 depicts mine workings in adjoining rocks with development of an oil deposit having a great oil stratum thickness by mining techniques.
Figure 9A:
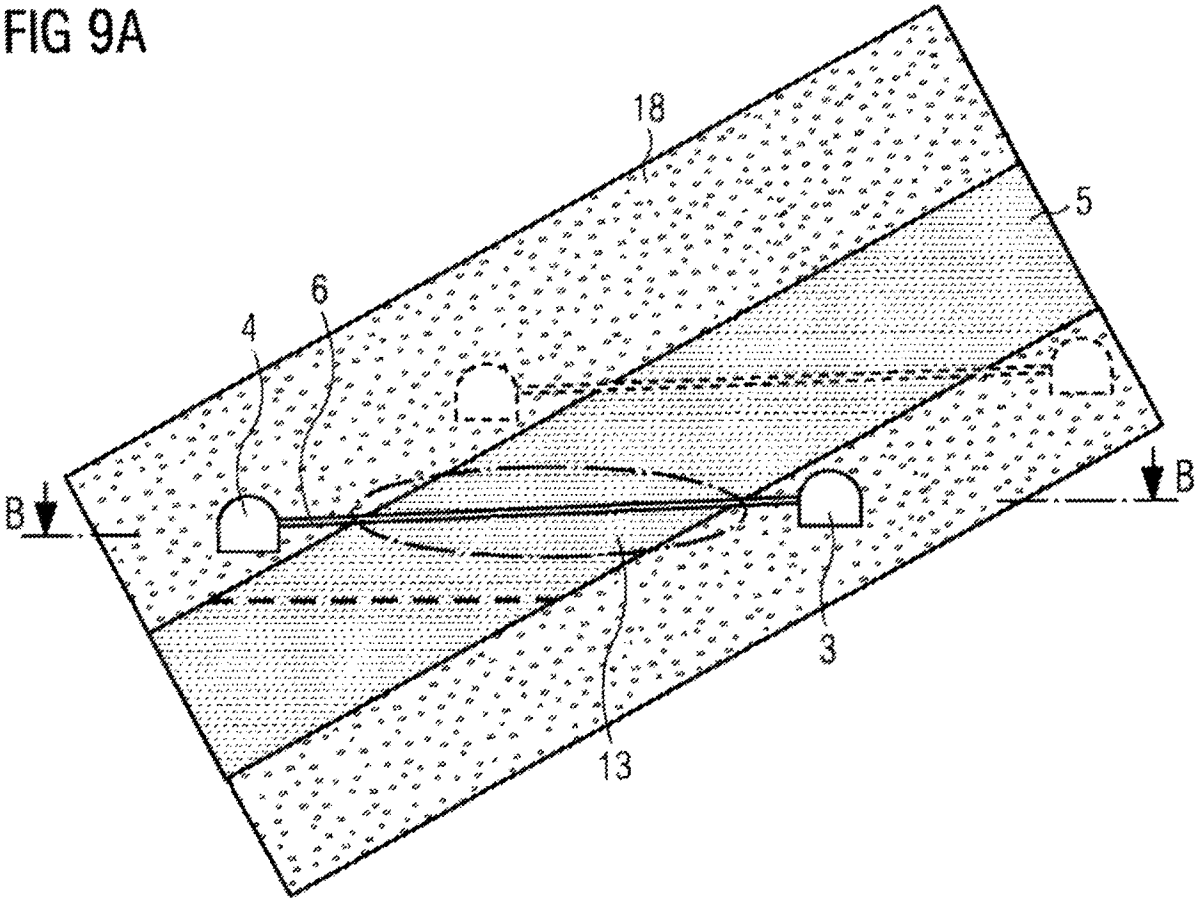

FIG. 9B depicts a plan view corresponding to the section B-B at the vertical level of the galleries 3 and 4 and the borehole 6. It is illustrated therein that an oil-bearing stratum 5 as depicted may also be curved or may assume any other arbitrary shape.

An advantage of the development by underground mining techniques of the deposit containing highly viscous oil by mine workings, in particular galleries (e.g., also day drifts) and shafts, is the enhanced recovery of oil.

Figure 10A:
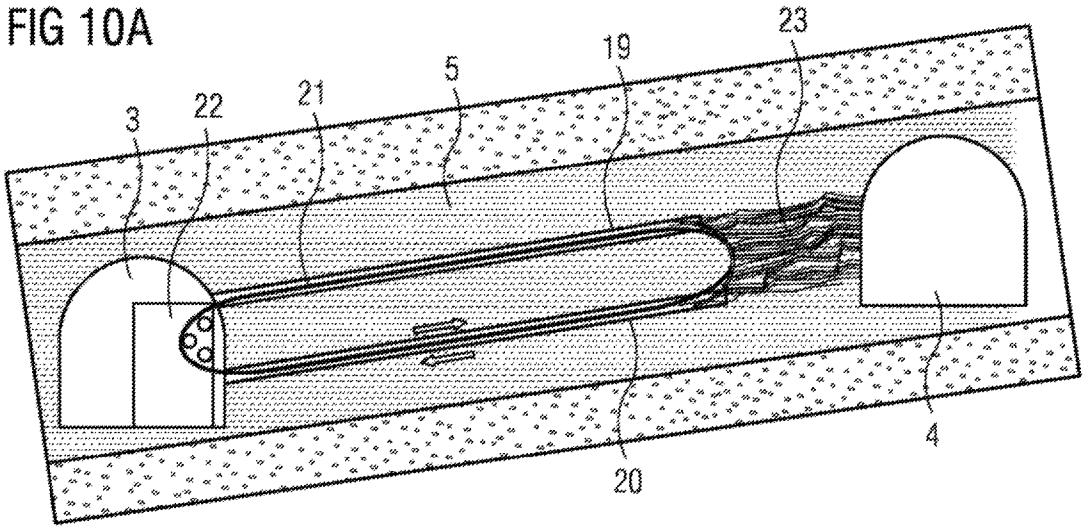
FIG. 10 depicts a mechanical forming of a continuous fissure between boreholes.
Figure 10B:
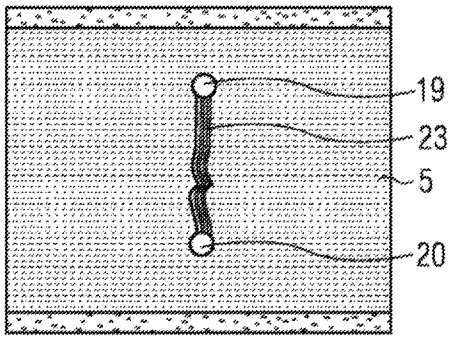
Figure 10C:
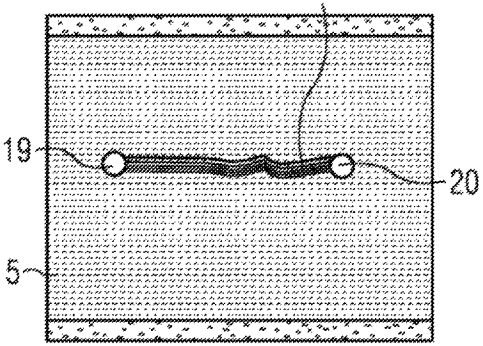

In order to enhance the recovery of oil, at least two further continuous quasi-parallel boreholes 19 and 20 may be drilled in the deposit block 12 in addition in the oil-bearing stratum 5 (c.f., FIG. 10). In FIG. 10, FIG. 10A depicts, analogously to FIG. 2, a vertical section parallel to one of the boreholes 6. FIG. 10B depicts a matching vertical section thereto. FIG. 10C depicts an alternative embodiment to FIG. 10B that does not correspond to FIG. 10A. The boreholes 19 and 20 are drilled in a vertical area (e.g., FIGS. 10A and 10B) or in the area of the dipping direction of the oil-bearing stratum 5 (e.g., FIG. 10C). A cable 21 of a drag-type cutter device 22 is run in the boreholes 19 and 20 and a fissure 23 is formed in the oil-bearing stratum 5 by sawing. The distance between boreholes 19 and 20 is 1-10 meters. The fissure 23, that may be formed continuously or non-continuously between mine workings 3 and 4, is also correspondingly wide.

As depicted in FIG. 10A, the fissure 23 begins at gallery 4 and ends as far as the drag-type cutter device 22 has advanced. The fissure 23 therefore becomes longer and longer during the operation of the drag-type cutter device 22. The fissure 23 extends starting from gallery 4 in the direction of the gallery 3.

When the deposit block 12 is heated, the oil flows into the fissure 23 and onward into the mine workings.

A drag-type cutter device 22 is ordinarily used for coal recovery and according to this embodiment, is also used for oil recovery. Bitumen and highly viscous oil deposits are often encountered in geological strata having degrees of solidity that are less than the solidity of the coal (e.g., in weakly cemented sand). In addition, the oil of the deposit acts as a lubricant during the reciprocating movements of the cable 21 in the boreholes 19 and 20. The frictional forces of the cable 21 are substantially reduced as a result and the energy of the drag-type cutter device 22 is utilized for the cutting/sawing of the oil-bearing stratum 5.

Figure 11:
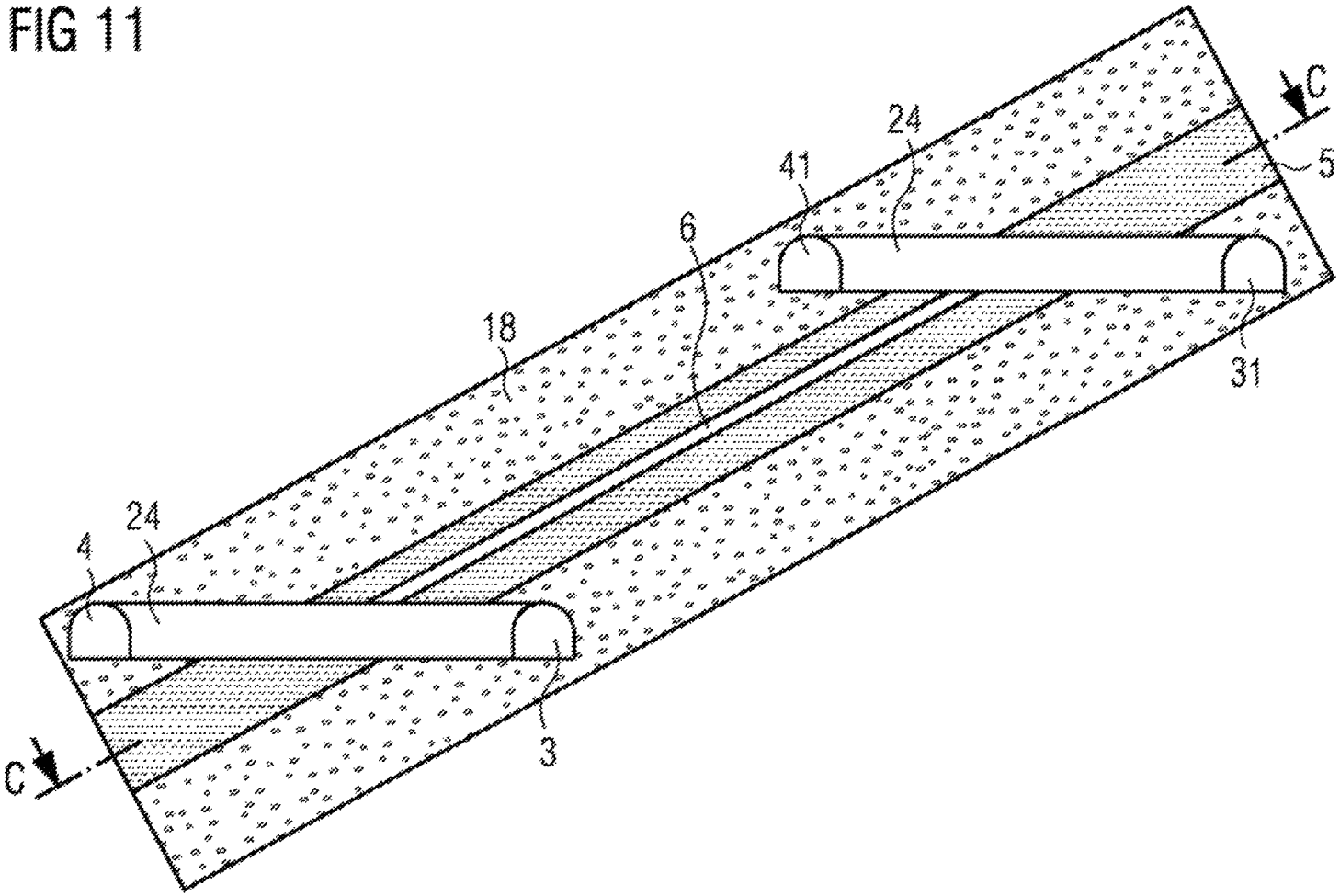
FIG. 11 depicts a vertical section through the oil deposit with two producing zones.
Figure 12:
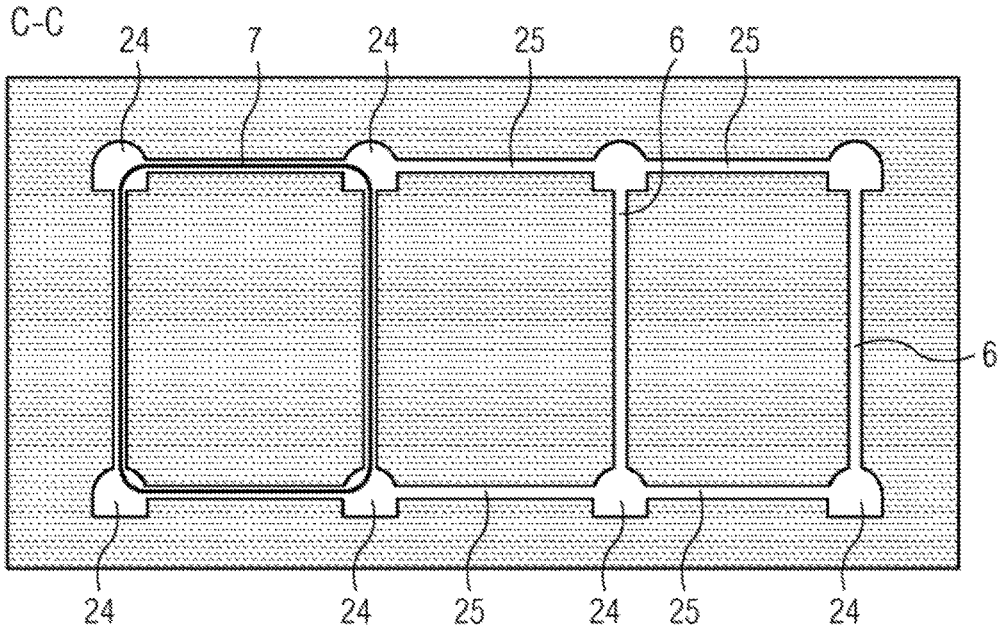
FIG. 12 depicts a section belonging to FIG. 11 along the surface area C-C.

According to another embodiment of the method or arrangement depicted in FIGS. 11 and 12, the mine workings are driven into at least two producing zones (e.g., of different depth) in adjoining rocks. The galleries 3 and 4 are provided at a first level as discussed above. In addition, the further galleries 31 and 41 are arranged in an analogous manner at a second level in the subsurface. Cut-throughs 24 are arranged between the gallery pairs 3 and 4, and 31 and 41 in each producing zone primarily in a horizontal plane (e.g., spaced apart at a distance of 20-50 meters from one another). The cut-throughs 24, constructed in different producing zones, are also connected by continuous boreholes 6.

The cut-throughs 24 (that likewise constitute a gallery) traverse the oil-bearing stratum 5. The cut-throughs 24 constructed in one producing zone are connected to one another by continuous boreholes 25 extending transversely to the cut-throughs. A conductor loop is installed in a first borehole 25 in the first producing zone, in a second borehole 25 in the second producing zone and in two boreholes 6, as depicted in FIG. 12 representing a section along the plane C-C, where the section C-C is in turn carried out in the oblique plane of the boreholes 6.

The induction loop of the conductor 7 introduced into the boreholes 24 and 6 (e.g., as depicted in FIG. 12) is supplied with current during operation in order to heat up the deposit (e.g., the oil-bearing stratum 5).

Figure 13:
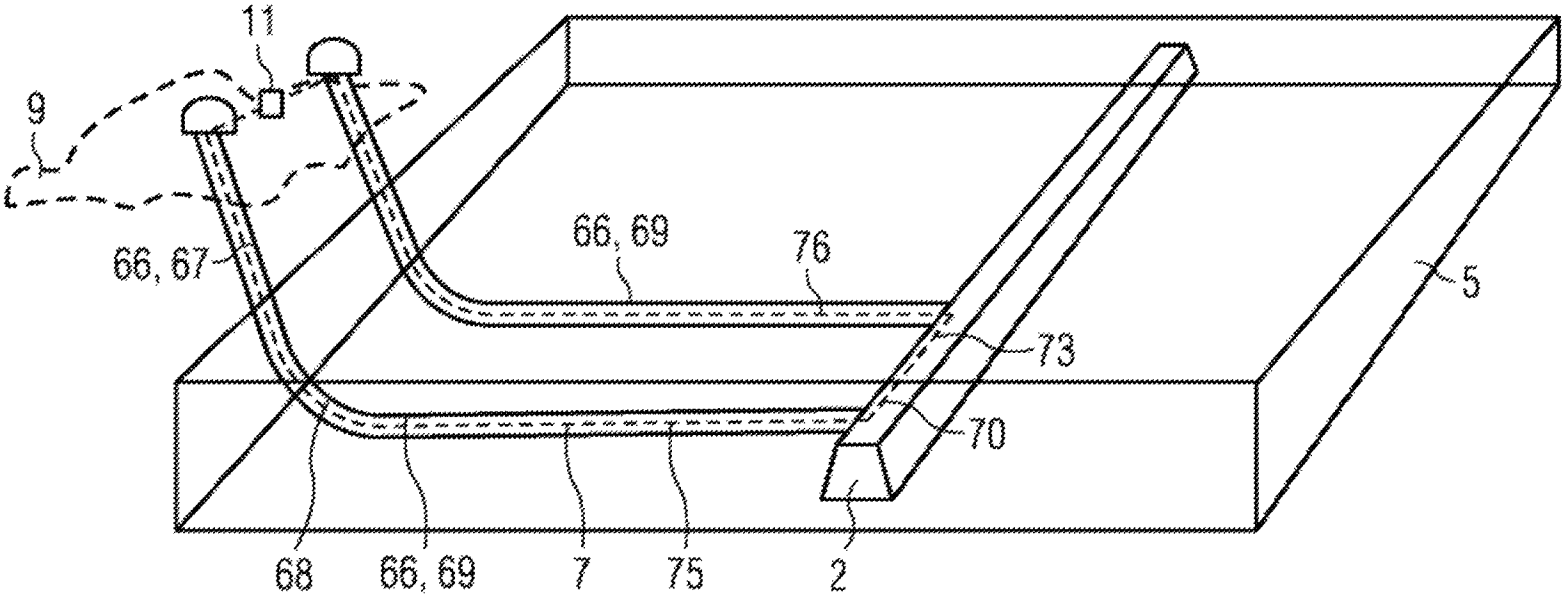
FIG. 13 depicts a deposit having a gallery.

In FIG. 13, only one gallery 2 (e.g., a mine working) is provided in which a section of the conductor 7 again comes to rest. However, the other sections of the conductor 7 are all guided through in boreholes 66 specifically provided for the conductor 7, wherein, in contrast to the previous embodiments, one borehole 67 is provided from the surface 9 that, in addition to a largely vertical section, transitions after a curve 68 into a substantially horizontal extension of the borehole 69. The borehole 69 ends in the gallery 2. Accordingly, starting from a frequency generator 11 from the surface 9, the conductor loop of the conductor 7 follows the borehole 67, the curve 68, the borehole 69 and a transverse section 70 in the gallery 2, as well as passing through a further of the boreholes 69, a further curve 68 and a further borehole 67 to the surface 9. At the surface, the conductor loop is closed, with the other end of the conductor loop likewise being connected to the frequency generator 11. The conductor loop is then powered by the frequency generator 11.

Using the gallery 2 for the conductor loop permits a conductor loop to be installed that, in the transition between the borehole 66 and the gallery 2, has a small radius of curvature which is significantly smaller than a curve that is allowed by a drill head. The conductor loop makes a sharp bend at this point. Accordingly, the boreholes may be restricted to one curved point each, as a result of which the drilling operation may be carried out more easily.

Figure 14:
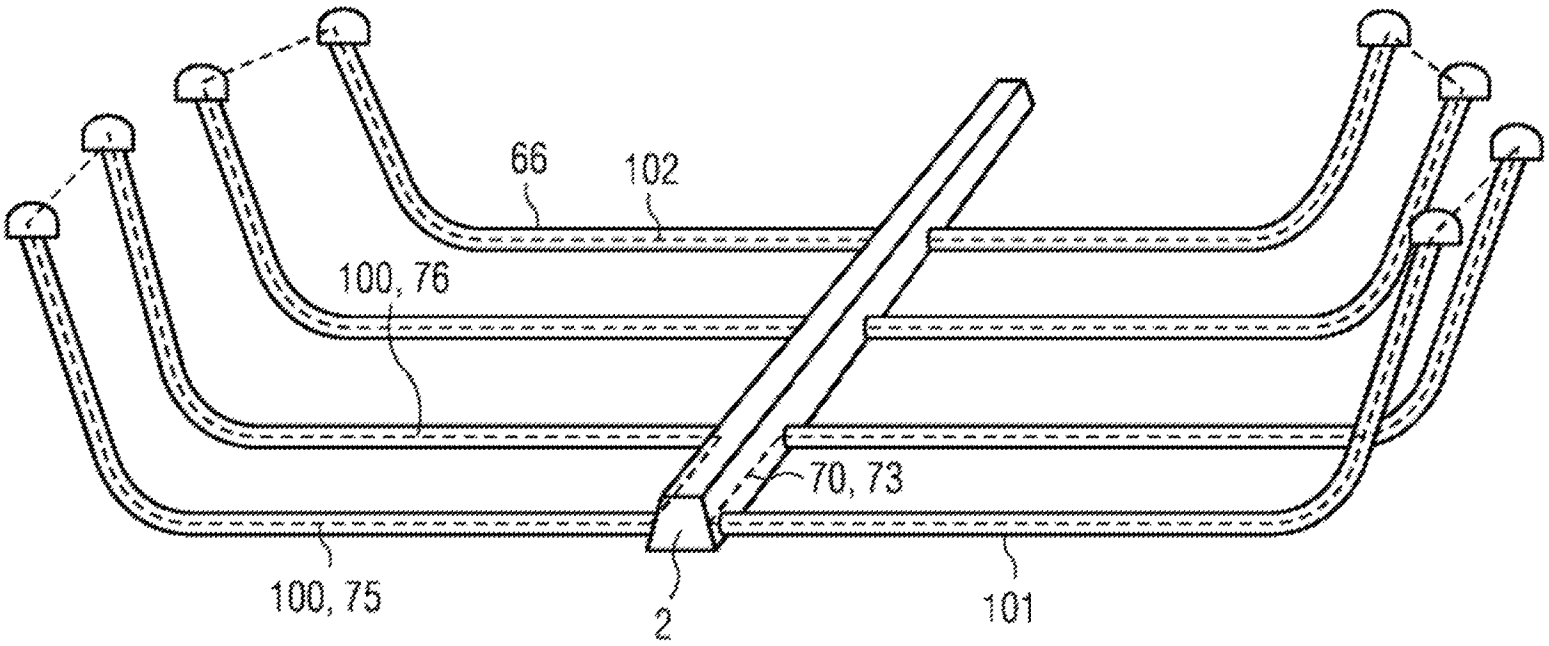
FIG. 14 depicts an alternative deposit having a gallery.

In FIG. 14, two conductor loops 100 and 101 are installed. Each conductor loop 100 and 101, as discussed above, includes a conductor section 70 in a gallery 2. Said conductor sections 70 may be provided such that they do not emit any electromagnetic waves, with the result that the conductor loops 100 and 101 exert no mutual detrimental effect on each other.

Also depicted in FIG. 14 is a conductor loop 102 that includes four boreholes from the surface, with two boreholes in each case meeting one another from opposite sides in the gallery 2.

Figure 15:
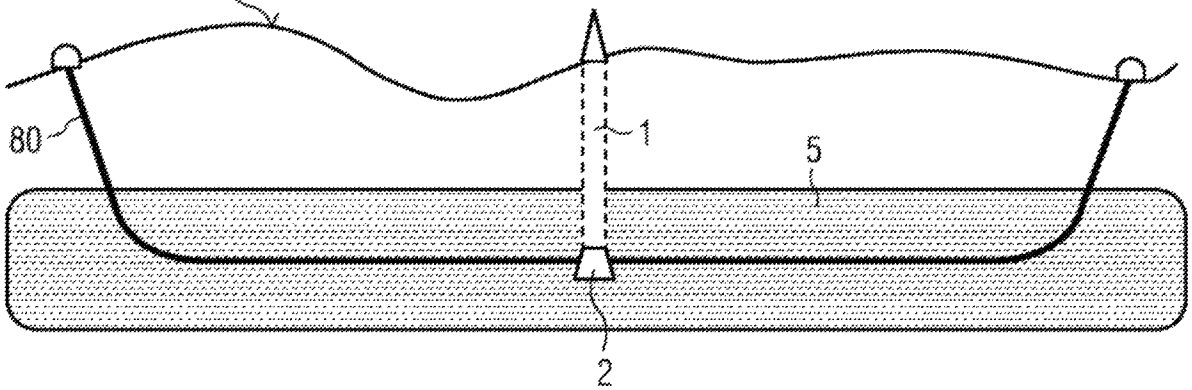
FIG. 15 depicts a vertical cross-section through the mine working and the deposit, with the mine working in the oil-bearing stratum.

FIG. 15 depicts the schematic of FIG. 14 in a vertical cross-section. A connection from the surface 9 into the oil-bearing stratum 5 is provided by an inclined shaft 80. At said stratum the shaft makes a bend into a substantially horizontal extension. The horizontally running shaft ends in the gallery 2 that is likewise situated in the oil-bearing stratum 5. The gallery 2 may be connected to a vertical shaft 1.

Figure 16:
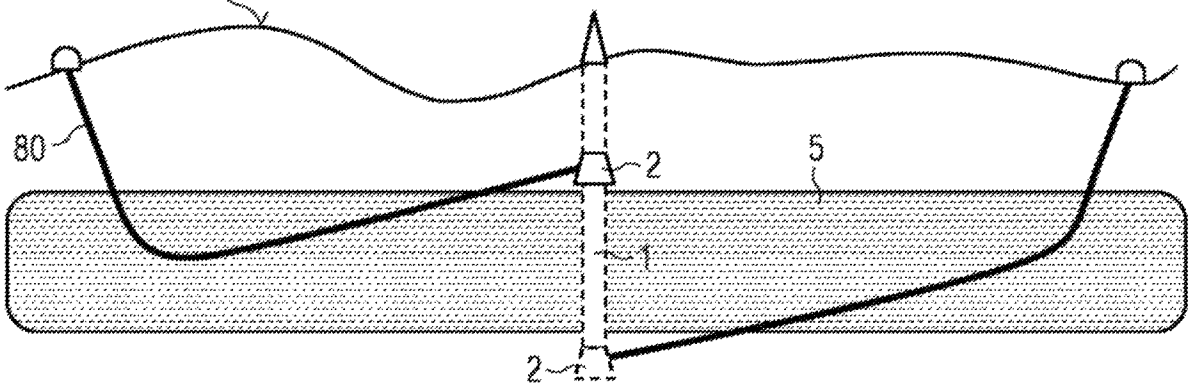
FIG. 16 depicts a vertical cross-section through the mine working and the deposit, with the mine working in adjoining rocks.
Figure 17:
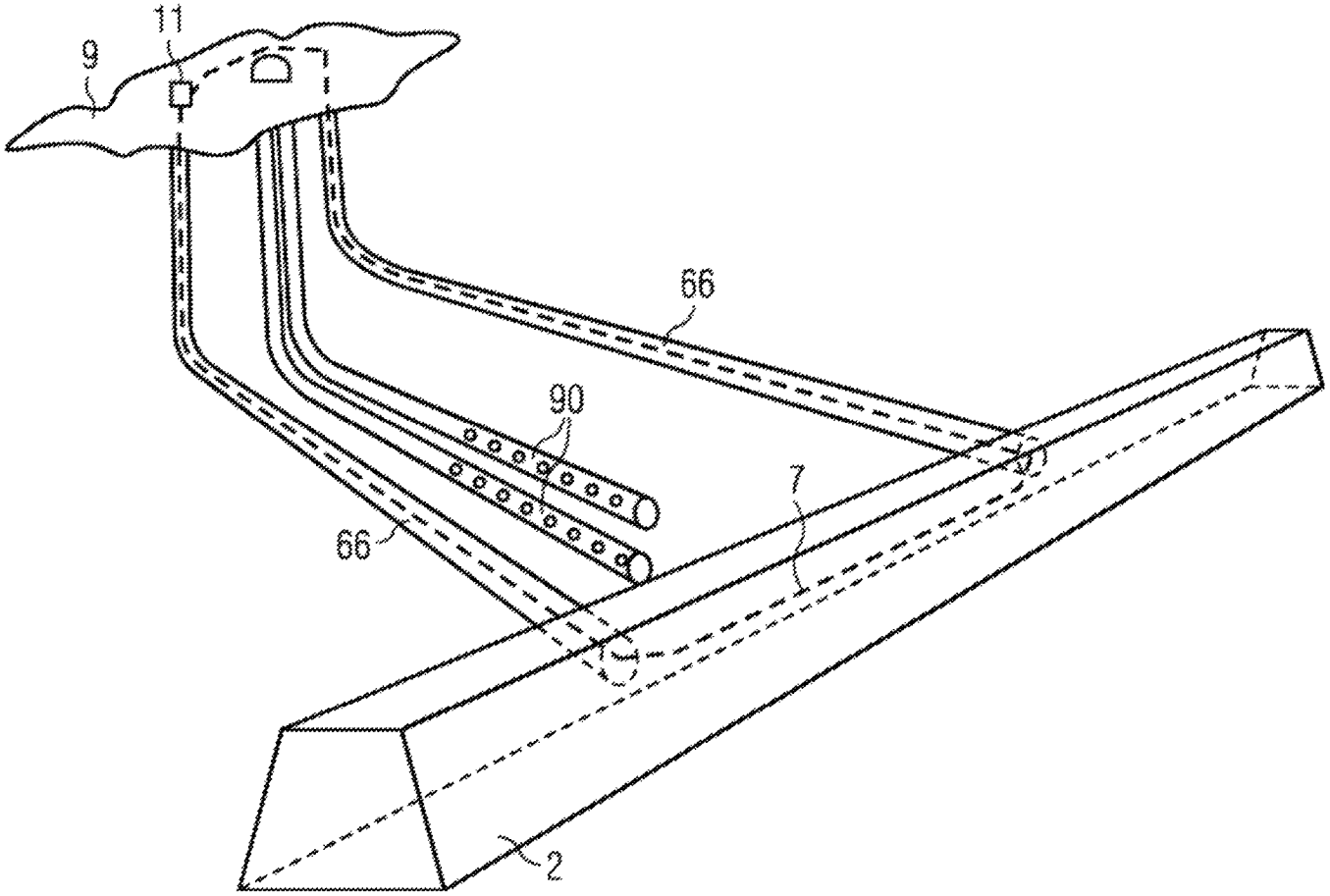
FIG. 17 depicts a development scheme for a deposit with four boreholes/mine working.

FIG. 16 depicts a slightly modified schematic of FIG. 14 in a vertical cross-section, wherein two galleries 2 are provided (e.g., one above the oil-bearing stratum 5 and one below the oil-bearing stratum 5). The two galleries 2 are located vertically one above the other and are connected to one another by a shaft 1. The borehole for the inclined shaft 80 is driven obliquely from the surface 9 into the oil-bearing stratum 5. After following a curve, the shaft is connected to one of the galleries 2 such that the shaft extends substantially straight ahead and is connected in a straight line to the gallery 2. If a conductor loop is installed in said borehole, the conductor loop runs to the greatest possible extent in the desired region of the oil-bearing stratum 5 and only runs outside of this zone in the peripheral region in the vicinity of the gallery or in the service conduit from the surface. FIG. 16 depicts a first implementation in which the gallery 2 is arranged above the oil-bearing stratum 5, and a second implementation in which the gallery 2 is arranged below the oil-bearing stratum 5.

Two separate conductor loops may be installed as depicted in the exemplary schematic of FIG. 16. A connection of two conductor loop halves by the two galleries 2 and the shaft 1 lying therebetween may also be provided.

In the embodiments described above, an above-ground installation of the frequency generator that feeds the inductor loop with a radiofrequency current may be provided. Alternatively, a below-ground installation may be provided. In an underground installation of the frequency generator, special requirements (e.g., in terms of explosion protection and/or cooling and/or weatherproofing) are to be taken into account.

In a surface installation, inverters are cooled by existing water supplies via water-water heat exchangers or by exposure to air via water-air heat exchangers. Primary candidates for cooling are the conducting-state power losses and switching losses of the power semiconductors, to ensure that the latter do not overheat.

Following heating of the deposit, high ambient temperatures, high humidity and possibly a lack of fluid recooling medium (e.g., mine drainage water), may prevail below ground. For this reason it may be necessary to employ an embodiment variantion that discharges the losses in an explosion-protected and weatherproof manner. For example, a thermosiphon or a heat pipe that may operate as a closed cooling system. The working medium of the closed cooling circuit, that may be based on evaporation for dissipating the heat and recondensation, may require a cold end in which the cooling medium is recondensed. An electrically driven heat pump may be used for this purpose. Suitable for use as a working medium in the cooling circuit are media which at normal pressure evaporate at between 60° C. and 120° C. (e.g., water).

A terminal box provided for connecting the forward and return conductor may also be implemented in an explosion-proof design that is sealed off from the inverter so that no explosive mine gases may infiltrate that would ignite due to partial discharges that are not to be ruled out on account of the electrical voltages of up to several kilovolts (kV) that are present there.

The presented embodiments include arrangements and methods that are advantageous for a bitumen deposit (e.g., having an oil viscosity of 100,000 centipoise (cP)). The deposit may be located at a depth of 150-200 meters below the surface. The deposit may be formed by an oil-bearing stratum having a thickness of 20-30 meters and an angle of dip of 25-30°. Under the given conditions in the stratum at a temperature of 8° C., the oil may be immobile or barely mobile due to high viscosity. The oil-bearing stratum may be composed largely of sand with a low degree of cementation. The surface may be partially built-up over the deposit contours.

For example, two vertical shafts may be drilled at the limit of the deposit contours. A borehole from the surface is not required.

The filling facilities as well as the transport and ventilation galleries may be constructed in the rocks adjoining the oil-bearing stratum.

Provided that the stability of the oil-bearing stratum is relatively high and the presence of gas relatively low, two galleries in addition to transport and ventilation galleries may be driven parallel to each other spaced apart at a distance of 200 meters directly in the oil-bearing stratum. Between these mine workings, continuous parallel boreholes may be drilled spaced at a distance of 20-30 meters. The boreholes are provided with pipework made of plastic and the electric cables that form the induction loop installed therein in at least two adjacent boreholes.

At least one firedamp-proof frequency generator may be installed below ground. After the deposit section has been heated, the induction loop may be removed and the crude oil recovered at reduced viscosity.

It is explained below with reference to FIGS. 17 to 22 how the method discussed above may be improved further by additional steam injection into the subsurface. This embodiment is a combination of boreholes, mine workings and a steam-assisted recovery technology.

An installation is implemented in a heavy oil deposit at a depth of approximately 200 meters in a flatly dipping sand stratum having irregular thickness which varies for example between 12 and 21 meters. The viscosity of the bitumen is approximately 50,000-100,000 centipoise (cP) and the deposit has very low permeability. As a result, a takeup of steam into the deposit through a steam injection well is small. This makes establishing the hydrodynamic communication between adjacent steam injection and production wells more difficult. The deposit has a determinable specific electrical resistance that is determined by ions dissolved in water and that results from the individual composition. Located below the bitumen stratum is a watery sand stratum having a thickness of approximately 5-10 meters. The electrical conductivity of the watery sand stratum is substantially higher than the electrical conductivity of the oil-bearing stratum. The gas content in the oil-bearing stratum is extremely low. The temperature of the deposit is for example 5-8° C. At this temperature the oil is not capable of flowing.

In order to optimize development of the deposit, combining horizontal drilling technology with underground mining technology is provided, as explained above and as illustrated in FIGS. 17-22. The deposit 5 is opened up for mining by an inclined shaft 6 and a horizontal mine working 2 that is advanced directly in the production layer (e.g., the oil-bearing stratum 5). Conventional underground mining techniques are employed for constructing the shaft 6 and the horizontal mine working 2. The length of the horizontal mine working 2 corresponds to the length of the deposit and may be 500-5000 meters long. Inclined boreholes 66 are drilled from the surface 9 with horizontal sections that are installed mainly in the watery sand stratum below the deposit. The inclined boreholes 66 intersect the horizontal mine working 2. The distance between the horizontal sections of the boreholes 66 may amount to 10-150 meters and the length to 200-2000 meters. An induction cable 7 is run in two horizontal boreholes 66 and in the mine working 2, thereby forming an induction loop. The induction loop is connected to the radiofrequency generator 11 and the inductive heating of the watery stratum commences radially around the supplying and returning sections of the induction loop 7. The temperature in said stratum may amount to approximately 70° to 300° C. following the full development of the process. The conductive and convective transfer of heat accounts for the relatively rapid increase in temperature in the overlying production layer. After the viscosity of the oil has been reduced, the oil is extracted and/or flooded through the additional boreholes 95. The additional boreholes 95 may be drilled from the mine working 2 or from the surface. Some of the additional boreholes 95 may be used for steam flooding.

According to an embodiment of the method, the horizontal sections of the boreholes 66 are drilled directly in the production layer 5 until they intersect the mine working 2. This embodiment may be used when there is a relatively large amount of indigenous water present in the production layer 5.

It is furthermore known to utilize suitable measures to equalize the viscosity of the water phase and the oil phase. The viscosity of the oil may be reduced and/or the viscosity of the aqueous flooding medium increased. Measures to reduce the oil viscosity include, for example, $CO_2$ flooding and steam flooding. The oil viscosity is reduced by $CO_2$ flooding due to the solvent-like action of the $CO_2$, and by steam flooding due to the increase in temperature. The viscosity of the aqueous flooding media may be increased by the addition of suitable viscosity-increasing additives. For example, viscosity-increasing additives may include polymer flooding (e.g., with the viscosity of the aqueous phase is increased by the addition of polymers), or foam flooding.

Figure 22:
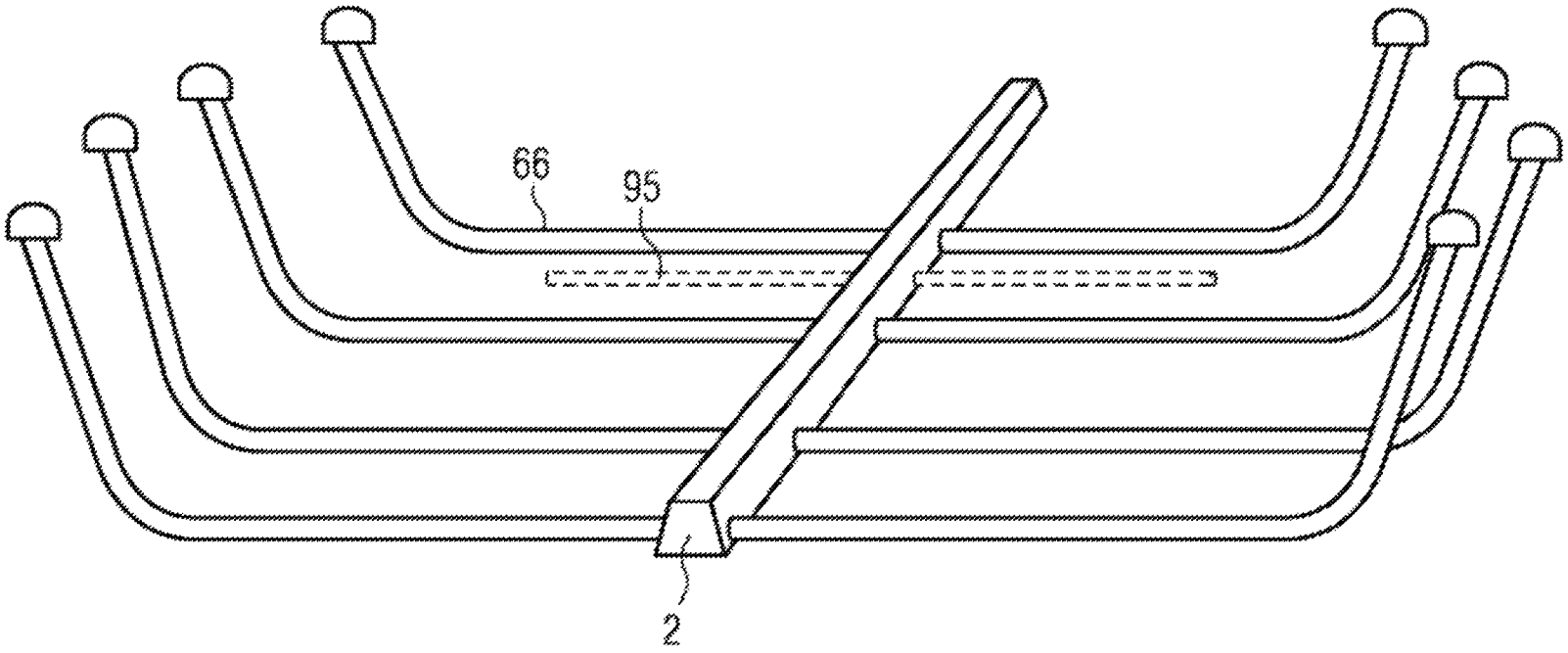
FIG. 22 depicts a development scheme for the deposit with two rows of horizontal boreholes.

During the temperature increase in the zone between two horizontal boreholes 66 (e.g., up to 70-300° C.), this zone may be flooded with aqueous urea solution through additional boreholes 95 (e.g., FIG. 22). During the heating of the urea solution in the hot zone of the deposit 5, hydrolysis of the urea commences, with gases being formed in the process (e.g., carbon dioxide and ammonia). The higher the temperature, the faster the hydrolysis of the urea proceeds. Carbon dioxide dissolves in the oil and the viscosity of the oil is reduced further Ammonia dissolves in the water and causes the formation in the deposit of an alkaline water bank that increases the oil recovery from the deposit by a tenside-like "wash-out effect". For example, the aqueous solution has the following composition: urea of 5 to 35% weight (wt.); and water constituting the remainder (e.g., 65%-95% weight (wt.)).

After the removal of the injection loop from the boreholes 66, the horizontal boreholes 66 may also be used for the flooding operation. In this embodiment, the flooding is carried out from the surface, after the end sections of the boreholes 66 have been plugged. The length of the plugs may amount to 50-500 meters, depending on the length of the horizontal well sections. The boreholes have either slotted pipes or they are boreholes without pipework lining.

The inductively heated zone may also be flooded with a viscous aqueous flooding medium which, in addition to water, has at least one glucan (G) having a β-1,3 glycosidically linked backbone chain and β-1,6 side chains glycosidically bound thereto, where the glucan has a weight-average molecular weight (Mw) of $1.5\times10^6$ to $25\times10^6$ grams per mole (g/mol). This flooding medium is associated with biopolymers and reduces viscosity only when the temperatures are above 120-140° C. The flooding medium may have the following composition: glucan (G) from 0.1 to 5 grams per liter (g/l); and water composing the remainder.

As a result of flooding, the inductively heated zone between two boreholes 66 with thickened water therein may result in an increase in oil recovery from this zone. If the zone has been overheated and exhibits temperatures above 140° C., the zone may initially be flooded with water or with aqueous urea solution. After the zone has been cooled down to 140° C., the polymer flooding may commence.

In addition to the aforementioned flooding, steam may also be introduced into the subsurface already in an earlier production phase. This is also referred to as SAGD (Steam Assisted Gravity Drainage). This combination of horizontal drilling technology with underground mining technology for mine workings and SAGD technology may be used for development and production. For this embodiment, the inductive heating of the deposit may be regarded as assistance for the SAGD method.

A SAGD well is referred to hereinbelow as a borehole that is used for the injection of steam or for transport and removal of the produced material. A SAGD well is not referred to as a borehole for a mine working or a borehole for the installation of an induction loop.

Figure 18:
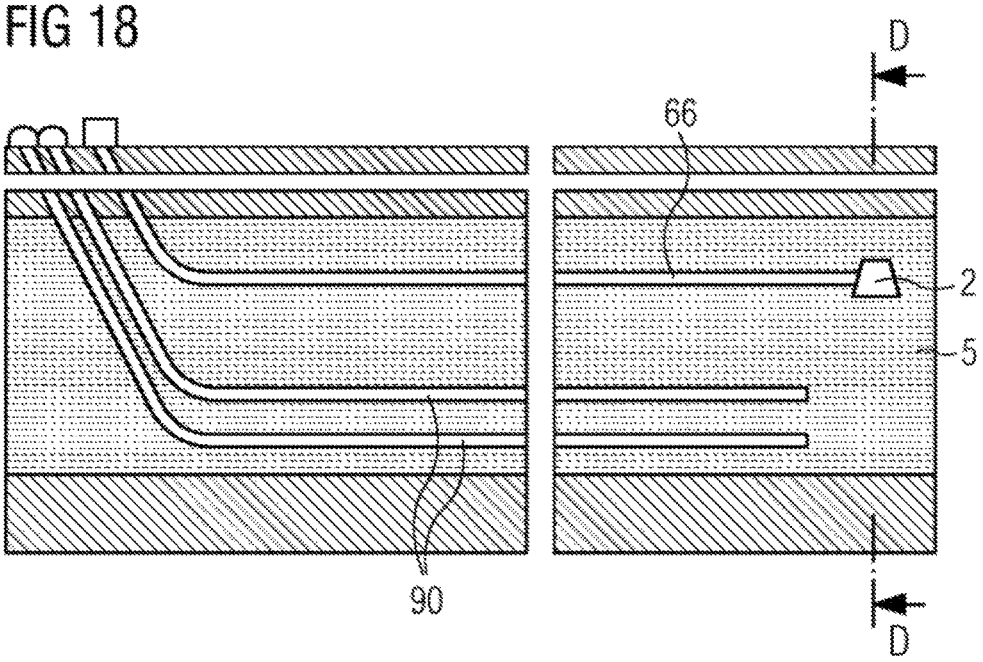
FIG. 18 depicts a vertical section through a deposit transversely to the mine working axis.
Figure 19:
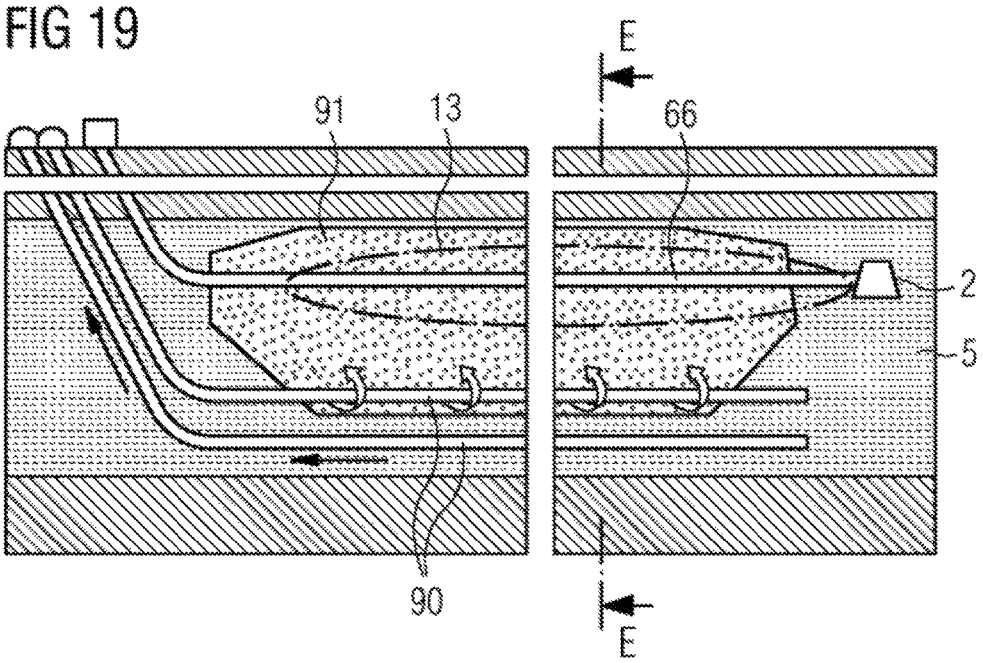
FIG. 19 depicts the vertical section of FIG. 18 through a deposit with development of the steam chamber.
Figure 20:
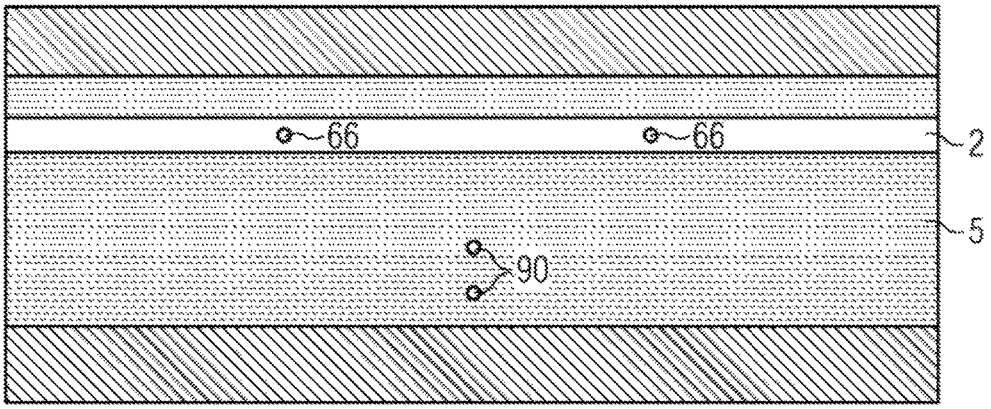
FIG. 20 depicts a vertical section through the deposit along the mine working, along surface area D-D.
Figure 21:
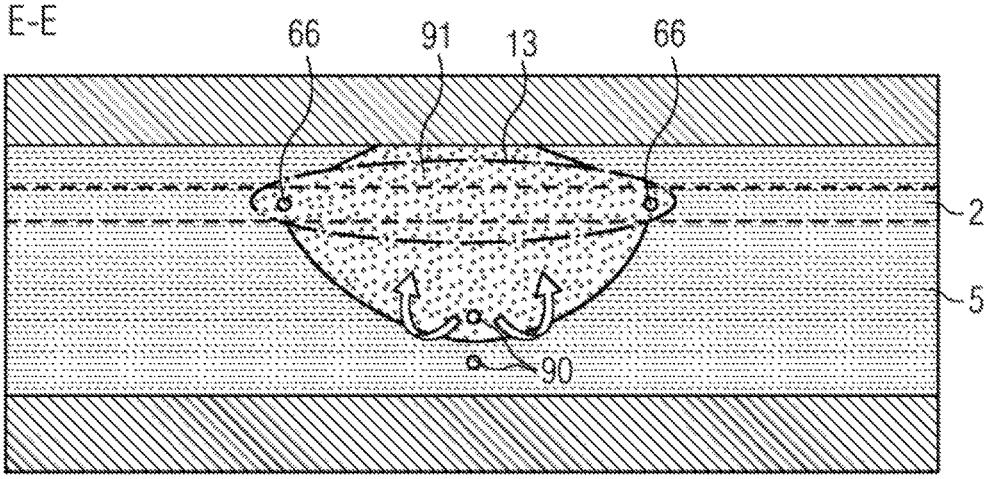
FIG. 21 depicts the vertical section of FIG. 20 after development of the steam chamber, along surface area E-E.

In this embodiment, the mine working 2 is driven into the production layer 5 (e.g., FIGS. 18 and 19). The deposit is developed by two additional horizontal boreholes 90. One of these boreholes is used as a steam injector and the other borehole lying thereunder as a production pipe. The distance between mine working 2 and well bottoms of the SAGD wells 90 amounts to 150-300 meters. This distance prevents steam breakthrough into the mine working 2. Following commencement of the steam injection, the mine working 2 may be advanced into the SAGD well 90. In order not to interfere with the SAGD method, the mine working 2 is driven outside of the action zone of the steam chamber 91. Two horizontal boreholes 66 for receiving a conductor loop are drilled from the surface as far as the intersection with the mine working 2 into the region in which the steam chamber 91 subsequently expands (e.g., FIG. 17). The distance (D) between the axes of the horizontal well sections 66 (e.g., FIG. 20, in which a cross-section in the plane D-D indicated in FIG. 18 is depicted) is equal to or somewhat greater than the width of the fully developed steam chamber 91 and may amount to 20-100 meters. The induction loop 7 installed in the boreholes 66 produces the temperature increase in the steam chamber 91. The inductively heated zone 13 (e.g., FIG. 21, in which a cross-section in the plane E-E indicated in FIG. 19 is depicted) reduces the consumption of steam or water and enables the SAGD method to be realized at reduced steam pressure. In the full development of the deposit, the horizontal boreholes are drilled from both sides of the mine working 2 (e.g., FIG. 22).

According to various embodiments discussed above, exploitation of an oil deposit by underground mining techniques is provided. For example, at least two quasi-parallel mine workings (e.g., galleries) may be provided in the oil-bearing stratum or in the adjoining rocks, wherein at least two continuous quasi-parallel boreholes may be drilled between the mine workings. An induction loop may be installed in the boreholes, wherein the start section and the end section of the induction loop are arranged in one mine working and a part of the induction loop is run freely between two borehole entrances in the other mine working. The mine working in which the start section and the end section of the induction loop are arranged is connected to the surface by a quasi-vertical borehole and the electric cables for connecting the induction loop to the frequency generator or frequency inverter are run in said borehole. A frequency inverter is placed in a mine working. Two quasi-parallel mine workings are driven at different depths and the start section and the end section of the induction loop are arranged in the mine working that is located at a higher level than the second mine working. At least one non-continuous producer well is drilled from a mine working between two continuous quasi-parallel boreholes in which the induction loop is arranged, which non-continuous producer well connects the heated deposit zone with one of two quasi-parallel mine workings. At least one producer well is drilled from the surface into the deposit zone heated by the induction loop. At least one non-continuous injection well is drilled from a mine working between two continuous quasi-parallel boreholes in which the induction loop is arranged. After the deposit zone between two continuous quasi-parallel boreholes has been heated, the returning or the supplying electric cable of the induction loop is removed from one borehole and laid in the adjacent continuous borehole. The borehole from which the electric cable has been removed is used as a production well. The borehole from which the electric cable has been removed is used as an injection well. The two quasi-parallel mine workings are driven in the striking direction of the oil-bearing stratum and the continuous boreholes are drilled in the dipping or floating direction of the oil-bearing stratum. A first mine working is driven in the roof rocks of the oil-bearing stratum and a second mine working is driven in the floor rocks of the oil-bearing stratum. The oil deposit is developed by slice mining and in the opposite direction to the dip line (e.g., rising extraction), wherein two quasi-parallel mine workings are driven for each slice. In addition, at least two further continuous quasi-parallel boreholes are drilled in the oil-bearing stratum between two continuous quasi-parallel boreholes, as a result of which a fissure is formed between the additional boreholes. The continuous fissure between additional boreholes is formed by a drag-type cutter device. The mine workings may be driven in at least two producing zones, the cut-throughs are driven between mine workings in each producing zone, and the cut-throughs are connected to one another by continuous boreholes.

The elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An arrangement for introducing heat into a deposit present in a geological formation to recover a hydrocarbon-containing substance from the deposit, the arrangement comprising:

at least one underground mine working, wherein the at least one underground mine working comprises at least one shaft, at least one gallery, or the at least one shaft and the at least one gallery; and an electrical conductor in a form of a conductor loop introduced at least partially in the geological formation, wherein the electronic conductor extends in a first conductor piece within the mine working, wherein the electronic conductor has a plurality of conductor sections provided such that during operation an electromagnetic field acts by electromagnetic induction on a ground adjacent to the plurality of conductor sections, therein increasing an adjacent ground temperature and decreasing a viscosity of a substance present in the adjacent ground, wherein the electronic conductor has a second conductor piece arranged in at least one borehole in the ground, wherein the conductor loop is provided horizontally with a first conductor section in a first borehole, wherein the first borehole ends in a first gallery running perpendicular thereto, wherein the conductor loop is provided horizontally with a second conductor section in a second borehole, wherein the second borehole ends in the first gallery, and wherein the conductor loop comprises a third conductor section which is arranged in the first gallery and provides a connection between the first conductor section and the second conductor section.

2. The arrangement of claim 1, wherein the at least one borehole comprises a curved section and a quasi-horizontal section and wherein the at least one borehole comprises an end in the mine working.

3. The arrangement of claim 1, wherein the second conductor piece is in contact with the ground.

4. The arrangement of claim 1, wherein the first conductor section is routed by way of the first borehole or routed by way of the at least one shaft to the ground, and wherein the second conductor section is routed by way of the second borehole or routed by way of the at least one shaft to the ground.

5. The arrangement of claim 1, wherein the first conductor section ends at an opposite end of the first gallery by way of the first borehole in a second gallery running perpendicular to the first borehole, wherein the second conductor section ends at the opposite end the first gallery by way of the second borehole in the second gallery running perpendicular to the second borehole, and wherein a fourth conductor section of the conductor loop is arranged in the second gallery.

6. The arrangement of claim 5, wherein a fifth conductor section of the conductor loop is arranged in a vertical borehole originating from the second gallery or in a vertical shaft originating from the second gallery, and wherein the fifth conductor section comprises a connection to a frequency generator.

7. The arrangement of claim 1, further comprising:

an injection pipe, a production pipe, or the injection pipe and the production pipe arranged within the first borehole, wherein:

the injection pipe is configured to feed a fluid into the geological formation, the deposit, or both the geological formation and the deposit, or the production pipe is configured to discharge a fluid extracted from the geological formation, from the deposit, or from both the geological formation and the deposit arranged within the second borehole.

8. The arrangement of claim 1, further comprising:

a frequency generator configured to drive the conductor, wherein the frequency generator is arranged at the ground or in the underground mine working.

9. The arrangement of claim 8, wherein ends of the conductor are connected in an explosion-protected terminal box, a weatherproof terminal box, or both the explosion-protected terminal box and the weatherproof terminal box that is/are self-contained and sealed off from the frequency generator.

10. The arrangement of claim 1, wherein the at least one gallery comprises a plurality of galleries, and wherein:

at least one gallery of the plurality of galleries is arranged in a striking direction of an oil-bearing stratum, or wherein a borehole provided for the conductor between two galleries of the plurality of galleries is arranged in an incline of a dip line or in the floating direction of the oil-bearing stratum.

11. The arrangement of claim 1, wherein the at least one gallery comprises a plurality of galleries, and wherein the mine working is provided in an oil-bearing stratum of the deposit, in rocks adjoining the deposit, or both in the oil-bearing stratum of the deposit and in the rocks adjoining the deposit, wherein the mine working in the adjoining rocks is provided such that the first gallery of the plurality of galleries is arranged in the roof rocks of the oil-bearing stratum, and wherein a second gallery of the plurality of galleries is arranged in the floor rocks of the oil-bearing stratum.

12. The arrangement of claim 1, wherein, between two quasi-parallel boreholes provided for the conductor, at least two additional quasi-parallel boreholes are provided in the oil-bearing stratum with a fissure lying between the least two additional quasi-parallel boreholes.

13. An arrangement for introducing heat into a deposit present in a geological formation to recover a hydrocarbon-containing substance from the deposit, the arrangement comprising:

at least one underground mine working, wherein the at least one underground mine working comprises at least one shaft, at least one gallery, or the at least one shaft and the at least one gallery;

an electrical conductor introduced at least partially in the geological formation, wherein the electronic conductor extends in a first conductor piece within the mine working, wherein the electronic conductor has at least one conductor section provided such that during operation an electromagnetic field acts by electromagnetic induction on a ground adjacent to the at least one conductor section, therein increasing an adjacent ground temperature and decreasing a viscosity of a substance present in the adjacent ground, wherein the electronic conductor has a second conductor piece arranged in a borehole in the ground; and an injection pipe, a production pipe, or both the injection pipe and the production pipe arranged between two conductor sections and parallel to the two conductor sections, wherein the two conductor sections are arranged at a first depth and run parallel, wherein the injection pipe is configured to feed a fluid that is to be injected, and wherein the production pipe is configured to discharge a fluid extracted from the geological formation from the deposit, or from the geological formation and the deposit.

14. The arrangement of claim 13, wherein the injected fluid is supplied to the injection pipe by way of the at least one shaft, the at least one gallery, or both the at least one shaft and the at least one gallery, or wherein the extracted fluid is discharged, collected, or both discharged and collected from the production pipe by way of the at least one shaft, the at least one gallery or the at least one shaft and the at least one gallery.

15. A method for introducing heat into a deposit present in a geological formation to recover a hydrocarbon-containing substance from the deposit, wherein a temperature in a heated zone is increased by supplying power to a conductor in an arrangement, the method comprising:

providing at least one underground mine working comprising at least one shaft, at least one gallery, or both the at least one shaft and the at least one gallery; and introducing the electrical conductor at least partially in the geological formation, wherein the electronic conductor extends in a first conductor piece within the mine working, wherein the electronic conductor has at least one conductor section provided such that during operation an electromagnetic field acts by electromagnetic induction on ground adjacent to the conductor section, therein increasing an adjacent ground temperature and decreasing a viscosity of a substance present in the adjacent ground, and wherein the electronic conductor has a second conductor piece arranged in a borehole in the ground, wherein the increasing of the temperature of the heated zone up to 140° C. is achieved by energizing the conductor, and wherein the heated zone is flooded with an aqueous fluid medium comprising water and at least one glucan having a β-1,3 glycosidically linked backbone chain and β-1,6 side chains glycosidically bound to the β-1,3 glycosidically linked backbone chain, wherein the glucan has a weight-average molecular weight from $1.5\times10^6$ to $25\times10^6$ g/mol.

16. A method for constructing an arrangement for introducing heat into a deposit present in a geological formation to recover a hydrocarbon-containing substance from the deposit, the method comprising:

providing at least one underground mine working in the geological formation, wherein the provided mine working comprises at least one shaft, at least one gallery or at least one shaft and at least one gallery;

introducing an electrical conductor at least partially in the geological formation;

installing the conductor in a first conductor piece within the mine working, arranging a second conductor piece of the conductor in a borehole in the ground such that the second conductor piece is in contact with the ground;

increasing a temperature of a heated zone up to 140° C. and decreasing a viscosity of a substance present in an adjacent ground by energizing the conductor through an electromagnetic induction on the adjacent ground to at least one conductor section of the conductor; and flooding the heated zone with an aqueous fluid medium comprising water and at least one glucan having a β-1,3 glycosidically linked backbone chain and β-1,6 side chains glycosidically bound to the β-1,3 glycosidically linked backbone chain, wherein the glucan has a weight-average molecular weight from $1.5\times10^6$ to $25\times10^6$ g/mol.

* * * * *